US009222347B1

(12) United States Patent
Walls

(10) Patent No.: US 9,222,347 B1
(45) **Date of Patent: *Dec. 29, 2015**

(54) HYDRAULIC FRACTURING SYSTEM AND METHOD

(71) Applicant: Gary C. Walls, Clymer, PA (US)

(72) Inventor: Gary C. Walls, Clymer, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/537,621

(22) Filed: Nov. 10, 2014

Related U.S. Application Data

(63) Continuation-in-part of application No. 14/515,896, filed on Oct. 16, 2014.

(51) Int. Cl.

| | |
|---|---|
| ***E21B 43/26*** | (2006.01) |
| ***E21B 34/00*** | (2006.01) |
| ***E21B 33/068*** | (2006.01) |
| *E21B 43/00* | (2006.01) |
| *E21B 28/00* | (2006.01) |

(52) U.S. Cl.
CPC ..... *E21B 43/26* (2013.01); *E21B 33/068* (2013.01); *E21B 34/00* (2013.01); *E21B 28/00* (2013.01); *E21B 43/003* (2013.01)

(58) Field of Classification Search
CPC ..... E21B 43/26; E21B 33/068; E21B 43/003; E21B 28/00
See application file for complete search history.

(56) References Cited

U.S. PATENT DOCUMENTS

| | | | | |
|---|---|---|---|---|
| 2,915,122 | A | | 12/1959 | Hulse |
| 3,020,720 | A | * | 2/1962 | Spalding ..... 60/532 |
| 3,602,311 | A | * | 8/1971 | Whitsitt ..... 166/308.1 |
| 3,765,804 | A | * | 10/1973 | Brandon ..... 417/540 |
| 3,981,624 | A | * | 9/1976 | Brandon ..... 417/53 |
| 4,049,056 | A | | 9/1977 | Godfrey |
| 4,548,252 | A | | 10/1985 | Stowe et al. |
| 4,714,114 | A | | 12/1987 | Jones |
| 5,836,393 | A | | 11/1998 | Johnson |
| 7,559,373 | B2 | | 7/2009 | Jackson et al. |
| 7,568,525 | B2 | | 8/2009 | Veselkov |
| 7,568,528 | B1 | | 8/2009 | Miller et al. |
| 7,810,520 | B2 | | 10/2010 | Perratone et al. |
| 7,836,948 | B2 | | 11/2010 | Kusko et al. |
| 8,061,421 | B2 | | 11/2011 | Samaroo et al. |
| 8,220,537 | B2 | | 7/2012 | Leon et al. |
| 8,225,856 | B2 | | 7/2012 | Kerfoot |
| 8,347,965 | B2 | | 1/2013 | Spence et al. |
| 8,714,257 | B2 | | 5/2014 | Kitzman |
| 8,789,601 | B2 | | 7/2014 | Broussard et al. |

* cited by examiner

*Primary Examiner* — Nicole Coy
(74) *Attorney, Agent, or Firm* — K&L Gates LLP

(57) ABSTRACT

A hydraulic fracturing system and method are disclosed. The system include a pulse-inducing system configured to deliver pulses of fluid to a fluid stream upstream of the wellbore. The pulse-inducing system can include at least one supplemental pump, at least one pulsation valve, and at least one pressure storage vessel. A hydraulic fracturing method can comprise generating a fluid stream via a primary pumping system, generating a pulsed output via a pulse-inducing system, and directing the pulsed output into the fluid stream upstream of a wellbore.

22 Claims, 16 Drawing Sheets

HYDRAULIC FRACTURING SYSTEM AND METHOD

RELATED APPLICATION

This non-provisional patent application is a continuation-in-part application under 35 U.S.C. §120 of U.S. patent application Ser. No. 14/515,896 entitled HYDRAULIC FRACTURING SYSTEM AND METHOD, filed Oct. 16, 2014 which is hereby incorporated by reference herein in its entirety.

FIELD

The present disclosure relates to hydraulic fracturing systems and methods for assembling and using the same.

BACKGROUND

Hydraulic fracturing can be used to stimulate and/or increase production from oil and gas wells. In a hydraulic fracturing process, fracturing fluid is pumped into a wellbore. Inside the wellbore, hydraulic pressure is employed to force the fracturing fluid into a formation. When the fracturing fluid enters the formation, the formation can fracture and channels and/or fissures can be created within the formation. Fracturing fluid can be pumped into the fractured formation to expand the fissures and/or to increase the size and/or quantity of fissures in the formation. The fracturing fluid can include water, chemicals, and proppants, such as sand, metal, and/or glass beads, for example, which can hold the fissures open. Because hydraulic fracturing can create fissures within a formation and can hold the fissures open, hydraulic fracturing can stimulate the release of oil and gas from the formation.

The equipment, including the pump(s), conduit(s), and/or manifold(s), for example, utilized in a hydraulic fracturing operation can operate up to and/or be rated to operate below a pressure threshold or maximum pressure $P_{max}$. In certain instances, the maximum pressure $P_{max}$ can be limiting factor in a hydraulic fracturing operation. For example, when a hydraulic fracturing system is operated at its maximum pressure ($P_{max}$), significant volumes of oil and/or gas may remain in the well. In such instances, it can be desirable to improve the effectiveness of a hydraulic fracturing operation, such that additional volumes of gas and/or oil can be extracted from the well, while operating below the maximum pressure ($P_{max}$) of the equipment.

Additionally, it can be desirable to extract gas and/or oil from the well using less water and/or less fracturing fluids, with reduced horsepower requirements and/or reduced emissions, and/or in fewer stages and/or more quickly. Additionally, it can be desirable to utilize hydraulic fracturing processes in expanded and/or additional areas. It can also be desirable to reduce the costs of hydraulic fracturing operations, reduce the static pressure required to fracture the formations and/or force the fracturing fluid into the formations, and/or improve the safety conditions at a hydraulic fracturing site. Moreover, it can be desirable to provide real time feedback information to the operators of the hydraulic fracturing equipment.

The foregoing discussion is intended only to illustrate various aspects of the related art in the field at the time and should not be taken as a disavowal of claim scope.

SUMMARY

In at least one form, a hydraulic fracturing system for introducing fracturing fluid into a wellbore comprises a manifold comprising a fluid outlet and a plurality of fluid inlets. The hydraulic fracturing system further includes a plurality of primary pumps, each of the primary pumps is fluidically coupled to one of the fluid inlets, and the primary pumps are configured to deliver a fluid stream to the fluid outlet. The hydraulic fracturing system further includes a pulse-inducing system configured to deliver pulses of fluid to the fluid stream upstream of the wellbore, and the pulse-inducing system comprises a supplemental pump, a pulsation valve, and a pressure storage vessel intermediate the supplemental pump and the pulsation valve.

In at least one form, the supplemental pump comprises a first supplemental pump, the pulsation valve comprises a first pulsation valve, the pressure storage vessel comprises a first pressure storage vessel, and the pulse-inducing system further comprises a second supplemental pump, a second pulsation valve, and a second pressure storage vessel intermediate the second supplemental pump and the second pulsation valve.

In at least one form, the manifold comprises a primary manifold, and the pulse-inducing system further comprises a first system manifold comprising a first inlet fluidically coupled to the first supplemental pump and a second inlet fluidically coupled to the second supplemental pump a second system manifold comprising a first outlet fluidically coupled to the first pulsation valve and a second outlet fluidically coupled to the second pulsation valve.

In at least one form, the first system manifold comprises a first isolation valve intermediate the first inlet and the second inlet, and the second system manifold comprises a second isolation valve intermediate the first outlet and the second outlet.

In at least one form, the hydraulic fracturing system further comprises a control system in communication with the first pulsation valve and the second pulsation valve.

In at least one form, the control system is in communication with the first isolation valve and the second isolation valve.

In at least one form, the hydraulic fracturing system further comprises a plurality of power units coupled to at least one of the primary pumps, first supplemental pump, or second supplemental pump, and the control system is in communication with the plurality of power units.

In at least one form, the first pulsation valve is configured to deliver pulses of a first magnitude at a first frequency, and the second pulsation valve is configured to deliver pulses of a second magnitude at a second frequency.

In at least one form, the first magnitude is different than the second magnitude.

In at least one form, the first frequency is different than the second frequency.

In at least one form, the manifold further comprises a supplemental inlet, and the pulse-inducing system is fluidically coupled to the supplemental inlet.

In at least one form, the hydraulic fracturing system further comprises a conduit extending from the fluid outlet to a wellhead of the wellbore and an auxiliary manifold intermediate the fluid outlet and the wellhead. The auxiliary manifold comprises a fluid inlet fluidically coupled to the pulse-inducing system.

In at least one form, the hydraulic fracturing system further comprises a first conduit extending from the fluid outlet to a wellhead of the wellbore and a second conduit extending from the pulsation valve to the wellhead.

In at least one form, a hydraulic fracturing system, comprises a manifold comprising a first fluid outlet, a second fluid outlet, and a plurality of fluid inlets. The hydraulic fracturing system further comprises a plurality of primary pumps. Each of the primary pumps is fluidically coupled to one of the fluid inlets. The primary pumps are configured to deliver a first fluid stream to the first fluid outlet, and the primary pumps are configured to deliver a second fluid stream to the second fluid outlet. The hydraulic fracturing system further comprises a pulse-inducing system fluidically coupled to the second fluid outlet and configured to deliver pulses of fluid to the first fluid stream.

In at least one form, the pulse-inducing system comprises a supplemental pump, a pulsation valve, and a pressure storage vessel intermediate the supplemental pump and the pulsation valve.

In at least one form, the pulse-inducing system further comprises a first system manifold and a second system manifold, and the pressure storage vessel is intermediate the first system manifold and the second system manifold.

In at least one form, the first system manifold comprises a first inlet fluidically coupled to the supplemental pump, and the second system manifold comprises a first outlet fluidically coupled to the pulsation valve.

In at least one form, the supplemental pump comprises a first supplemental pump, the pulsation valve comprises a first pulsation valve, the pressure storage vessel comprises a first pressure storage vessel, and the pulse-inducing system further comprises a second supplemental pump, a second pulsation valve, and a second pressure storage vessel intermediate the second supplemental pump and the second pulsation valve.

In at least one form, the first system manifold comprises a second inlet fluidically coupled to the second supplemental pump, and the second system manifold comprises a second outlet fluidically coupled to the pulsation valve.

In at least one form, the first system manifold comprises a first isolation valve intermediate the first inlet and the second inlet, and the second system manifold comprises a second isolation valve intermediate the first outlet and the second outlet.

In at least one form, they hydraulic fracturing system further comprises a control system in communication with the first pulsation valve and the second pulsation valve.

In at least one form, the first pulsation valve is configured to deliver pulses of a first magnitude for a first duration at a first frequency, and the second pulsation valve is configured to deliver pulses of a second magnitude for a second duration at a second frequency.

In at least one form, the first magnitude is different than the second magnitude, and the first frequency is different than the second frequency.

In at least one form, a hydraulic fracturing method for introducing fracturing fluid into a wellbore comprises generating a fluid stream via a primary pumping system, generating a pulsed output via a pulse-inducing system, and directing the pulsed output into the fluid stream upstream of the wellbore.

In at least one form, generating the pulsed output in the hydraulic fracturing method comprises at least one of controlling a power unit, an isolation valve, or a pulsation valve of the pulse-inducing system.

BRIEF DESCRIPTION OF THE DRAWINGS

Various features and advantages and the manner of attaining them will become more apparent and will be better understood by reference to the following description of embodiments in conjunction with the accompanying drawings, in which.

DETAILED DESCRIPTION

Certain exemplary embodiments will now be described to provide an overall understanding of the principles of the structure, function, manufacture, and use of the devices, systems, and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments is defined solely by the claims. The features illustrated or described in connection with one exemplary embodiment may be combined with the features of other embodiments. Such modifications and variations are intended to be included within the scope of the present disclosure.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment", or "in an embodiment", or the like, in places throughout the specification are not necessarily all referring to the same embodiment. Additionally, reference throughout the specification to "various instances," "some instances," "one instance," or "an instance", or the like, means that a particular feature, structure, or characteristic described in connection with the instance is included in at least one instance. Thus, appearances of the phrases "in various instances," "in some instances," "in one instance", "in an instance", or the like, in places throughout the specification are not necessarily all referring to the same instance.

Furthermore, the particular features, structures, or characteristics may be combined in any suitable manner in one or more embodiment or instance. Thus, the particular features, structures, or characteristics illustrated or described in connection with one embodiment or instance may be combined, in whole or in part, with the features structures, or characteristics of one or more other embodiment or instance without limitation. Such modifications and variations are intended to be included within the scope of the present disclosure.

Figure 1:
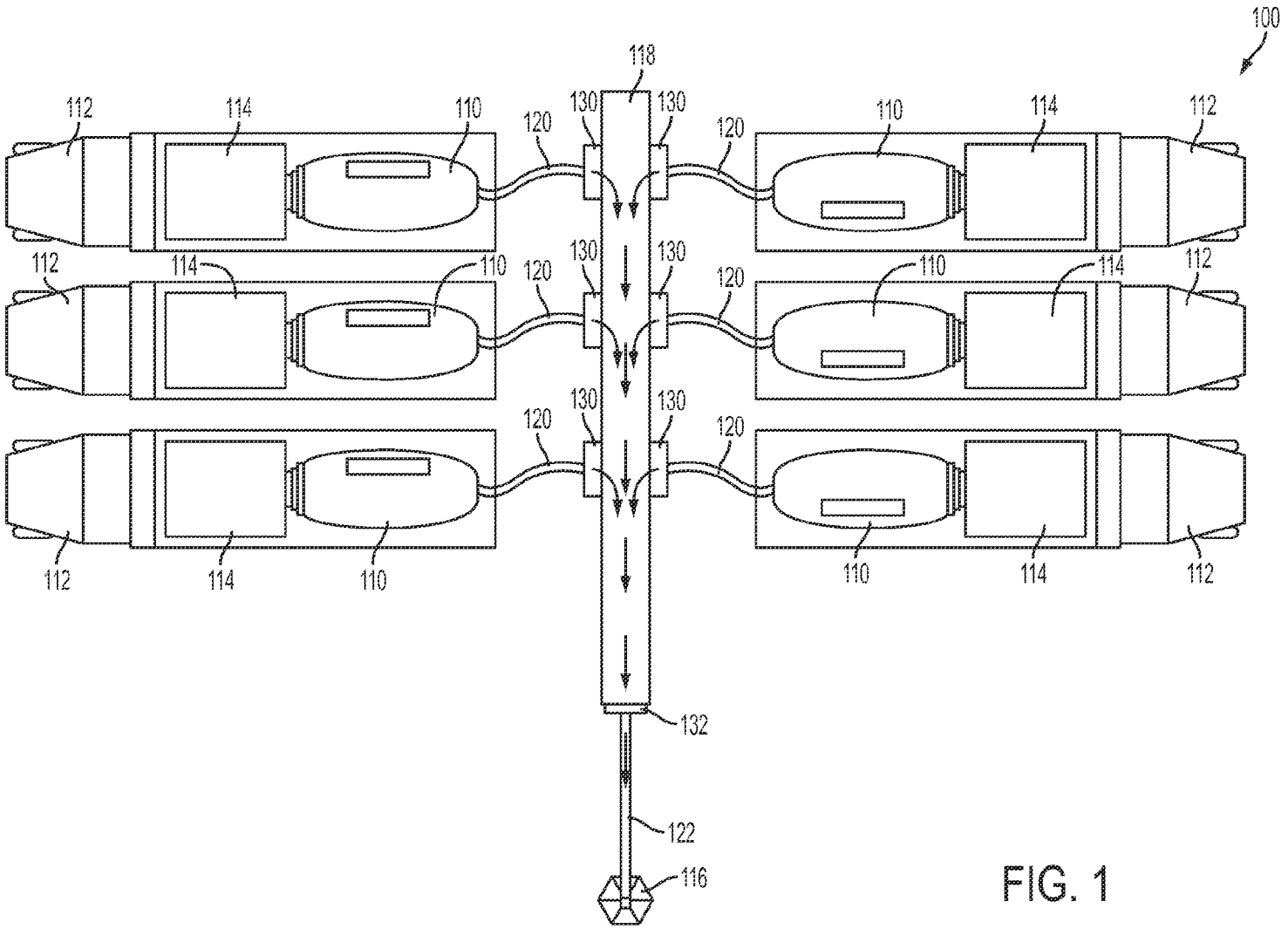
FIG. 1 is a schematic depicting a hydraulic fracturing system that includes a plurality of primary pumps, a manifold operably in fluid communication with the primary pumps, and a wellhead operably in fluid communication with the manifold, according to various embodiments of the present disclosure.

FIG. 1 is a schematic depicting a hydraulic fracturing system 100. The depicted hydraulic fracturing system 100 includes multiple primary pumps 110 in fluid communication with a manifold 118. The depicted manifold 118 is operably configured to be in fluid communication with a wellhead 116. In the depicted arrangement, the primary pumps 110 are configured to pump fluid and supply the pumped fluid to the wellhead 116 via the manifold 118, as well as various additional conduits and/or fluid lines, which are described in greater detail herein.

The primary pumps 110 can be high-pressure, high-volume fracturing pumps. In certain instances, the primary pumps 110 can be piston pumps. For example, the pumps 110 can be triplex or quintuplex piston pumps. The primary pumps 110 can be rated up to 22,000 psi and 115 gallons per minute, for example. At a lower value psi, the primary pumps 100 can be rated up to 1375 gallons per minute, for example.

In various instances, the primary pumps 110 can be portable or mobile, for example. For example, each primary pump 110 can be mounted to a vehicle 112, such as a truck or a trailer, for example. In certain instances, the primary pumps 110 can be moved around the hydraulic fracturing site and/or can be relocated to different hydraulic fracturing sites. In some instances, multiple primary pumps 110 can be mounted to each vehicle 112. Referring to FIG. 1, the hydraulic fracturing system 100 can include six (6) primary pumps 110. In other instances, the hydraulic fracturing system 100 can include less than six (6) primary pumps 110 or more than six (6) primary pumps 110. For example, the hydraulic fracturing system 100 can include a single primary pump 110, or seven (7) or more primary pumps 110.

Referring still to FIG. 1, the primary pumps 110 can be powered by motors 114. The motors 114 can also be mounted to the vehicles 112, for example. In other instances, the motors 114 can be independent of the vehicles 112. In various instances, the motors 114 can be diesel-powered motors, for example. An exemplary, non-limiting motor is the Caterpillar 3516C High Displacement marine engine, for example.

The primary pumps 110 can be fluidically connected to the wellhead 116 via fluid lines 120, the manifold 118, and/or a conduit 122. For example, the vehicles 112 can be positioned near enough to the manifold 118 such that a fluid line 120 connects each primary pump 110 to the manifold 118. The manifold 118 can include a plurality of inlets 130 and an outlet 132. In certain instances, the inlets 130 can be equally-spaced along the length of the manifold 118. In other instances, at least two inlets 130 can be unequally spaced. Additionally or alternatively, an inlet 130 can be positioned at an end of the manifold 118. Referring to the embodiment depicted in FIG. 1, the manifold 118 includes six (6) inlets 130, and each inlet 130 is coupled to a fluid line 120. In other instances, the manifold 118 can include additional inlets 130, which may be used in certain operations and may remain unused in other operations. In various instances, the outlet 132 can be positioned at an end of the manifold 118. In other instances, the outlet 132 can be positioned along the length thereof and/or can be between two inlets 130. Referring to the embodiment depicted in FIG. 1, the manifold 118 includes a single outlet 132.

Fracturing fluid can flow along a fluid path or stream within the manifold 118. Referring to FIG. 1, a fluid path is indicated by the arrows. For example, fracturing fluid can enter the manifold 118 at the inlets 130 along the length of the manifold 118, and can flow toward the outlet 132. Additionally, the manifold 118 can be connected to the wellhead 116 by a fluid line or conduit 122. The conduit 122 can be configured to deliver the fracturing fluid from the manifold 118 to the wellhead 116. The manifold 118 and conduit 122 can be rated to withstand high pressures.

Various components of fracturing fluid can be supplied to the primary pumps 110. For example, water, chemicals, and/or proppants can be supplied to one or more of the primary pumps 110. In certain instances, the hydraulic fracturing fluid supplied to the primary pumps 110 can be pre-mixed. For example, a slurry blender can mix various components, and the mixture can be fed into one or more of the primary pumps 110. In some instances, at least one primary pump 110 in the system 100 can be coupled to a water supply, at least one primary pump 110 in the system 100 can be coupled to a chemical supply, and/or at least one pump 110 in the system can be coupled to a proppant supply. For example, referring to FIG. 1, five (5) of the primary pumps 110 can supply water and chemicals to the manifold 118, and one (1) of the primary pumps 110 can supply proppants to the manifold 118.

Proppants can include sand, metal and/or glass beads, and/or other solid material, for example. The proppants can be various sizes, and multiple different size proppants can be included in a hydraulic fracturing fluid. Chemical additives can include lubricants, for example. In various instances, chemical additives and/or proppants can comprise approximately 0.5% of the total volume of fracturing fluid delivered to the wellhead 116.

The hydraulic fracturing system 100 may also include blenders or mixers, which can be configured to mix and blend the components of the hydraulic fracturing fluid, and to supply the hydraulic fracturing fluid to the primary pumps 110. Water, chemicals, and/or proppants can be supplied to the system 100 by additional vehicles, conduits, and/or conveyors. The hydraulic fracturing system 100 can further include at least one monitoring unit, which can monitor the composition and properties of the fracturing fluid, the volume of various supplies, and/or the flow rate, density, and/or pressure of the fracturing fluid at various locations within the system 100.

Referring still to FIG. 1, the primary pumps 110, which supply fracturing fluid components and/or the fracturing fluid to the manifold 118, can be configured and/or designed to supply a constant flow rate and uniform pressure into the wellbore 116. For example, an operator can control the primary pumps 110 to supply a relatively constant flow rate and pressure. As a result, the flow rate and pressure of the fracturing fluid exiting the manifold 118 can be constant or substantially constant.

In certain instances, the generation and introduction of pulses or waves of fracturing fluid into the fluid stream can improve the effectiveness of the hydraulic fracturing operation. For example, pulses of fracturing fluid can create additional fissures within a formation and/or can enlarge preexisting fractures. More specifically, pulses of fracturing fluid can force a proppant, such as sand, for example, further down the borehole and into the formation to further enlarge the width and/or extend the length of the fissure and to hold the fissure open. Because pulses of fracturing fluid can expand the fractured region, the addition of pulses to a fracturing operation can generate more oil and/or gas from the well. The addition of pulses can also extend hydraulic fracturing to areas where it would otherwise be cost prohibitive.

A pulse of fracturing fluid can also provide a pressure shock signal to the operator. For example, microseismic energy measurement device(s) at the surface can measure the microseismic events and/or conditions within and around the wellbore. The device can then communicate the measurements to the operator in real time.

The pulses of fracturing fluid within the fluid stream can be mechanically induced. For example, a supplemental pump can generate a mechanical pulse or wave of fracturing fluid, which can be fed into the fluid stream. In certain instances, the supplemental pump can provide periodic pulses, for example, which can generate corresponding periodic pressure increases or spikes within the fluid stream. In other instances, the pulses can be intermittent and/or sporadic. An operator can control the supplemental pump to deliver pulses periodically and/or sporadically, for example.

In certain instances, multiple supplemental pumps can be configured to generate pulses of fracturing fluid, which can be delivered to the fluid stream. The pulses can be output from different supplemental pumps and can have different frequencies and/or different amplitudes, for example. In various instances, the pulses from different supplemental pumps can overlap, and/or can concurrently join the fluid stream. In other instances, the pulses can be staggered and/or can intermittently join the fluid stream. In certain instances, at least one supplemental pump can be configured to deliver small pulses to the fluid stream, and at least one supplemental pump can be configured to deliver larger pulses to the fluid stream.

Large pulses of fracturing fluid can break apart rock formations, thus providing more channels and/or fissures within the formation. Additionally, large pulses of fracturing fluid can stimulate proppants and lubricants in the fracturing fluid, and can force additional proppants and lubricants within the fissures. Large pulses of fracturing fluid can also increase abrasion within the fissures, which can further enlarge a fissure. Moreover, large pulses of fracturing fluid can provide a shock signal to the operator.

Small pulses of fracturing fluid can also stimulate proppants in the fracturing fluid, which can force additional proppants within the fissures. As proppants are forced further into the fissures, the fissures can be enlarged. Additionally, the small pulses of fracturing fluid can also provide a shock signal to the operator.

Figure 2:
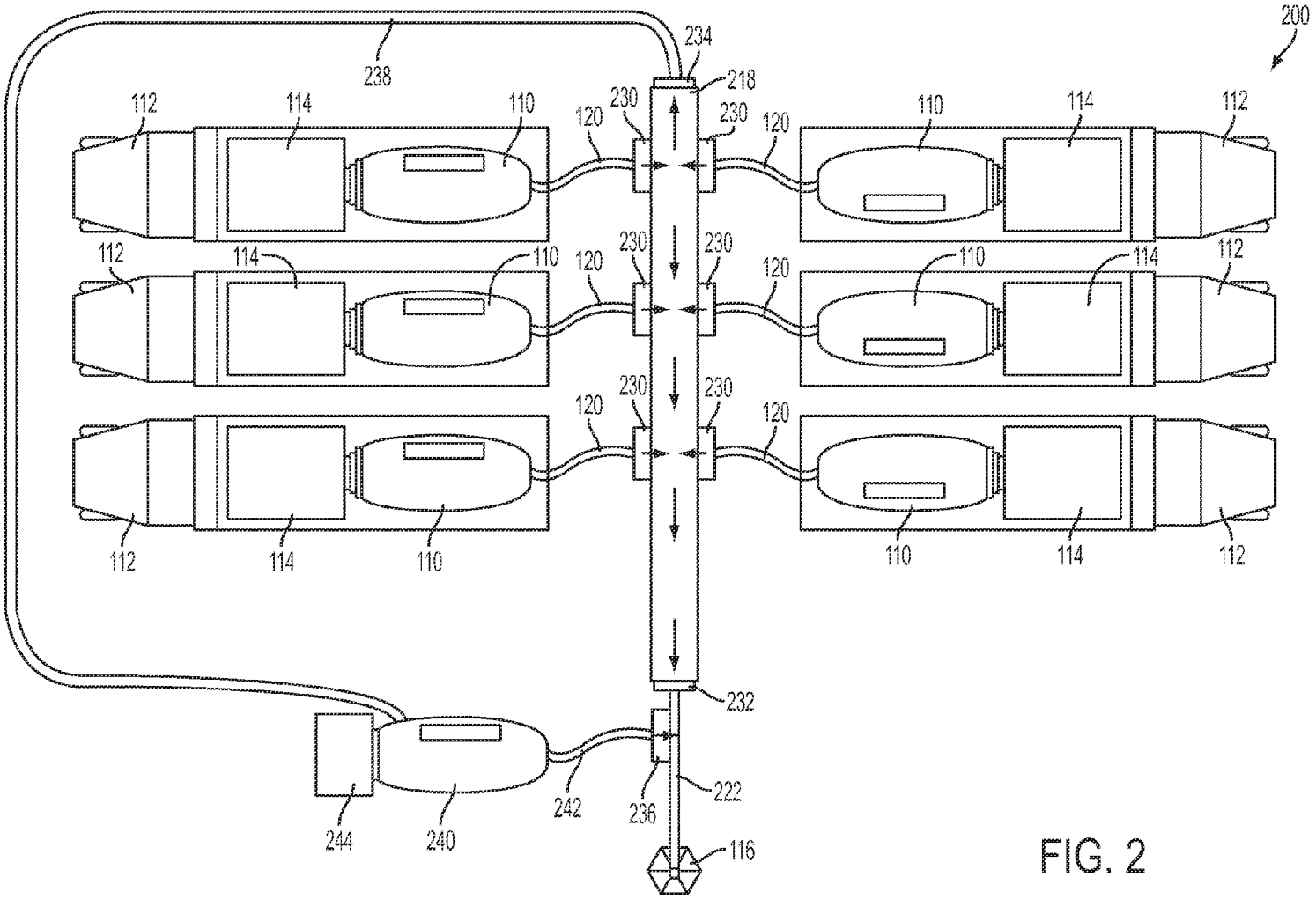
FIG. 2 is another schematic depicting a hydraulic fracturing system that includes the primary pumps and the wellhead of FIG. 1, and further includes a supplemental pump and a manifold, further depicting the manifold operably in fluid communication with the supplemental pump and with the primary pumps, according to various embodiments of the present disclosure.

Referring now to FIG. 2, a hydraulic fracturing system 200 is depicted. Similar to the system 100, the hydraulic fracturing system 200 includes the primary pumps 110, the motors 114, the vehicles 112, the fluid lines 120 extending from the primary pumps 110, and the wellhead 116. The hydraulic fracturing system 200 also includes a manifold 218 and a supplemental pump 240, which can be coupled to and/or driven by a power unit and/or motor 244.

Referring still to FIG. 2, the manifold 218 includes a plurality of inlets 230, which are coupled to the fluid lines 120. Accordingly, the fluid lines 120 permit fluid communication between the pumps 110 and the manifold 218. The manifold 218 depicted in FIG. 2 also includes a primary outlet 232, which is coupled to a primary conduit 222. The primary conduit 222 extends between the manifold 218 and the wellhead 116, and can operably permit a fluid stream to flow from the manifold 218 to the wellhead 116. Similar to the hydraulic fracturing system 100, the primary pumps 110 can supply a constant flow rate and uniform pressure into the manifold 218. As a result, the flow rate and pressure of the fracturing fluid exiting the manifold 218 can be constant or substantially constant.

The supplemental pump 240 can be in fluid communication with the manifold 218 via a supplemental outlet 234 to the manifold 218 and a supplemental conduit 238. For example, a first portion of the fluid stream that is injected or pumped into the manifold 218 from the primary pumps 110 via the fluid lines 120 can flow from the inlets 230 toward the primary outlet 232. Additionally, a second portion of the fluid stream that is injected or pumped into the manifold 218 from the primary pumps 110 can be diverted to the supplemental outlet 234. The second portion of the fluid stream can flow to the supplemental pump 240, for example.

In various instances, the supplemental pump 240 can be configured to induce at least one pulse of fluid into the fluid stream. For example, the supplemental pump 240 can generate a pulse of fracturing fluid, which can flow from the pump 240 through a connecting conduit 242. Thereafter, the mechanically-induced pulse of fluid can join the fluid stream generated by the primary pumps 110.

The mechanically-induced pulse or pulses generated by the supplemental pump 240 can be generated outside of the wellbore, for example, and can be transmitted to the fluid stream outside of the wellbore, for example. In various instances, the pulse or pulses can enter the fluid stream downstream of the plurality of inlets 230 to the manifold 218. For example, the pulses can be introduced to the fluid stream between the manifold 218 and the wellhead 116. In various instances, the supplemental pump 240 can transmit the mechanically-induced pulses to the connecting conduit 242, and the connecting conduit 242 can be coupled to the primary conduit 222. For example, the connecting conduit 242 and the primary conduit 222 can be coupled at a supplemental manifold or union intermediate the manifold 218 and the wellhead 116.

Figure 3:
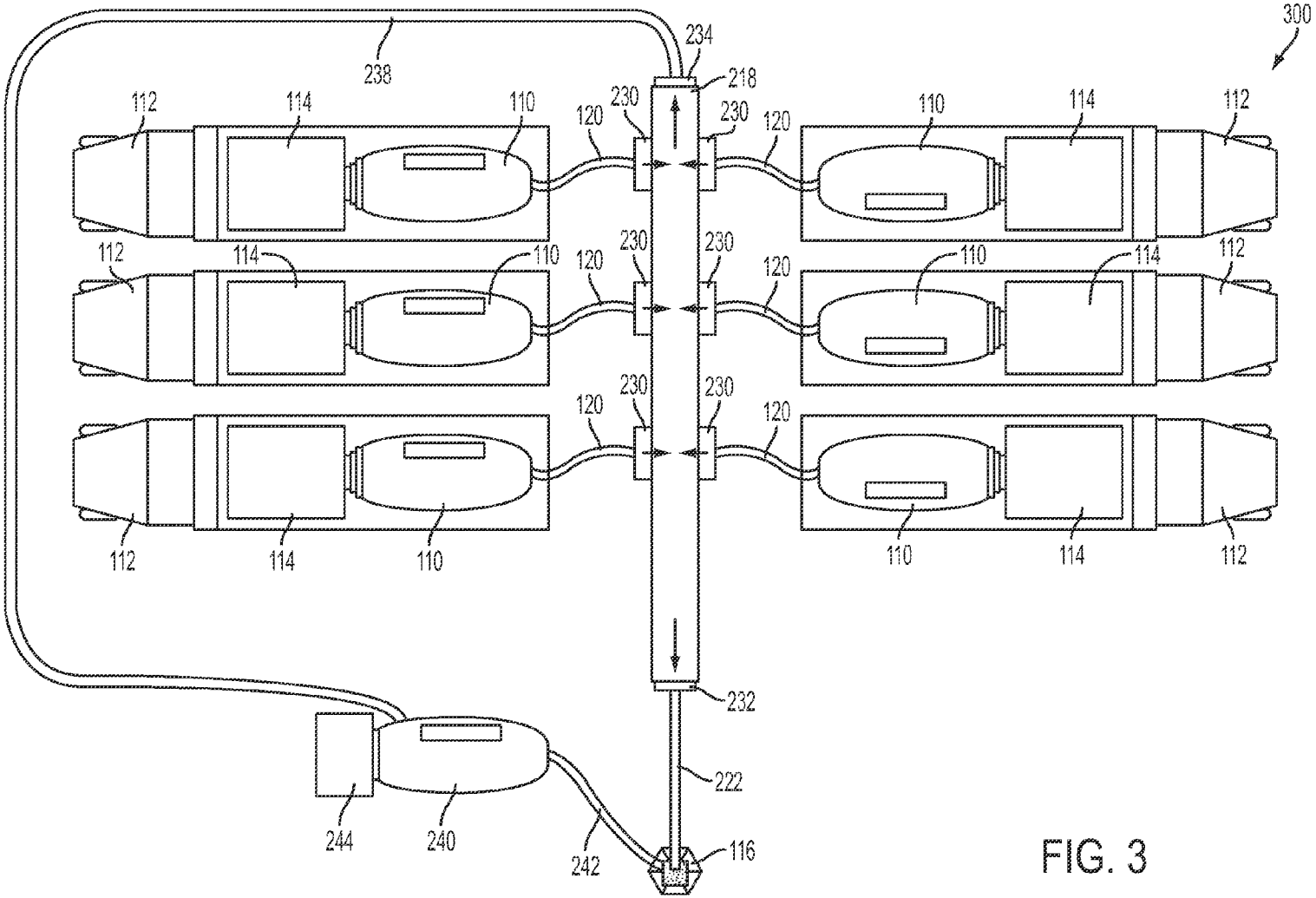
FIG. 3 is another schematic depicting a hydraulic fracturing system that includes the primary pumps and the wellhead of FIG. 1, and further includes the supplemental pump and the manifold of FIG. 2, according to various embodiments of the present disclosure.

In other instances, a supplemental, pulse-generating pump can transmit the pulse or pulses to the fluid stream at the wellhead 116. For example, referring to FIG. 3, a hydraulic fracturing system 300 is depicted. The hydraulic fracturing system 300 can be similar to the hydraulic fracturing system 200, except the connecting conduit 242 can extend between the supplemental pump 240 and the wellhead 116. In such instances, the mechanically-induced pulse(s) from the supplemental pump 240 can be transmitted to the stream of fracturing fluid entering the wellhead 116.

In still other instances, a supplemental, pulse-generating pump can transmit the pulse or pulses to the fluid stream within the manifold. For example, referring to FIG. 4, a hydraulic fracturing system 400 is depicted. The hydraulic fracturing system 400 can be similar to the hydraulic fracturing system 200. Additionally, the hydraulic fracturing system 400 can include a manifold 418 having a plurality of inlets 430 in fluid communication with the primary pumps 110 via the fluid lines 120. The manifold 418 can also include a primary outlet 432 in fluid communication with the wellhead 116 and a supplemental outlet 434 in fluid communication with the supplemental pump 240, which can be coupled to and/or driven by a power unit and/or motor 244. The manifold 418 depicted in FIG. 4 further includes a supplemental inlet 436 downstream of the primary inlets 430. In the depicted arrangement, the connecting conduit 242 extends between the supplemental pump 240 and the supplemental inlet 436 such that the pulse or pulses generated by the supplemental pump 240 are directed into the fluid stream at the manifold 418.

Figure 4:
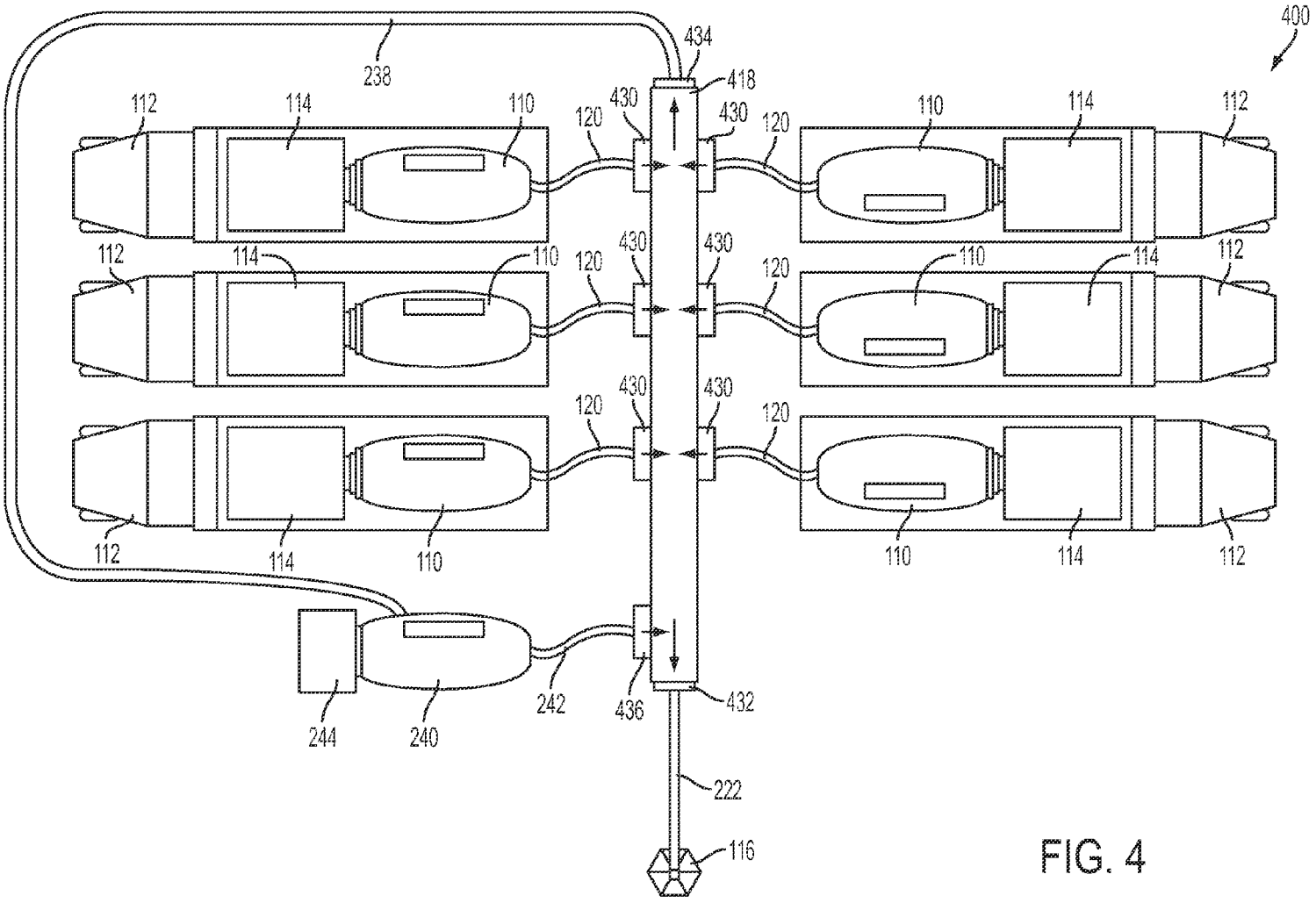
FIG. 4 is another schematic depicting a hydraulic fracturing system that includes the primary pumps and the wellhead of FIG. 1, further includes the supplemental pump of FIG. 2, and further includes a manifold in fluid communication with the supplemental pump and with the primary pumps, according to various embodiments of the present disclosure.

In various pump arrangements described herein, the supplemental pump 240 (FIGS. 2-4) can receive fluid input from the manifold 218 (FIGS. 2 and 3), 418 (FIG. 4). In other words, a portion of the fluid stream pumped into the manifold 218, 418 can be diverted to the supplemental pump 240. In such arrangements, the supplemental pump 240 can receive a portion of the fluid pumped into the system 200, 300, 400 from the primary pumps 110. In various instances, the portion of the fluid stream directed to the supplemental pump 240 can be diverted from the fluid stream before proppants and/or other additives are added to the fluid stream. Accordingly, clogging and/or contamination of the supplemental pump 240 by proppants, for example, can be prevented and/or minimized.

In certain instances 5%-50% of the fluid from the primary pumps 110 can be diverted to the supplemental pump 240. For example, approximately 25% of the fluid from the primary pumps 110 can be diverted to the supplemental pump 240. In other words, as an example, if 80 barrel units were pumped into the manifold 218 (FIGS. 2 and 3), 418 (FIG. 4), 60 barrel units could be directed to the primary outlet 432 as a fluid stream, and 20 barrel units could be directed to the supplemental outlet 434. In other instances, less than 5% or more than 50% of the fluid from the primary pumps 110 can be diverted to the supplemental pump 240.

In various arrangements, the primary pumps 110 can generate a maximum pressure in the manifold 218 (FIGS. 2 and 3), 418 (FIG. 4). For example, when each primary pump 110 is operated to its maximum capacity, a maximum operating pressure $P_{max}$ can be achieved in the manifold 218, 418. Moreover, when a portion of the fluid stream is diverted to the supplemental pump 240, as described herein, the pressure in the manifold 218, 418 may drop. In certain instances, the pressure can drop 5%-50% in the manifold 218, 418. For example, the pressure can drop approximately 25% within the manifold 218, 418. In other instances, the pressure drop can be less than 5% or more than 50%. When the supplemental pump 240 redirects the diverted fluid stream back into the primary fluid stream as a pulse or wave of fluid, the pressure can increase toward the maximum pressure $P_{max}$, for example. In certain instances, the pressure in the fluid stream can approach $P_{max}$, however, the pressure may not reach $P_{max}$ due to frictional losses, for example. For example, the total pressure from the fluid stream in combination with the peak of each pulse can approach $P_{max}$ of the system.

Figure 5:
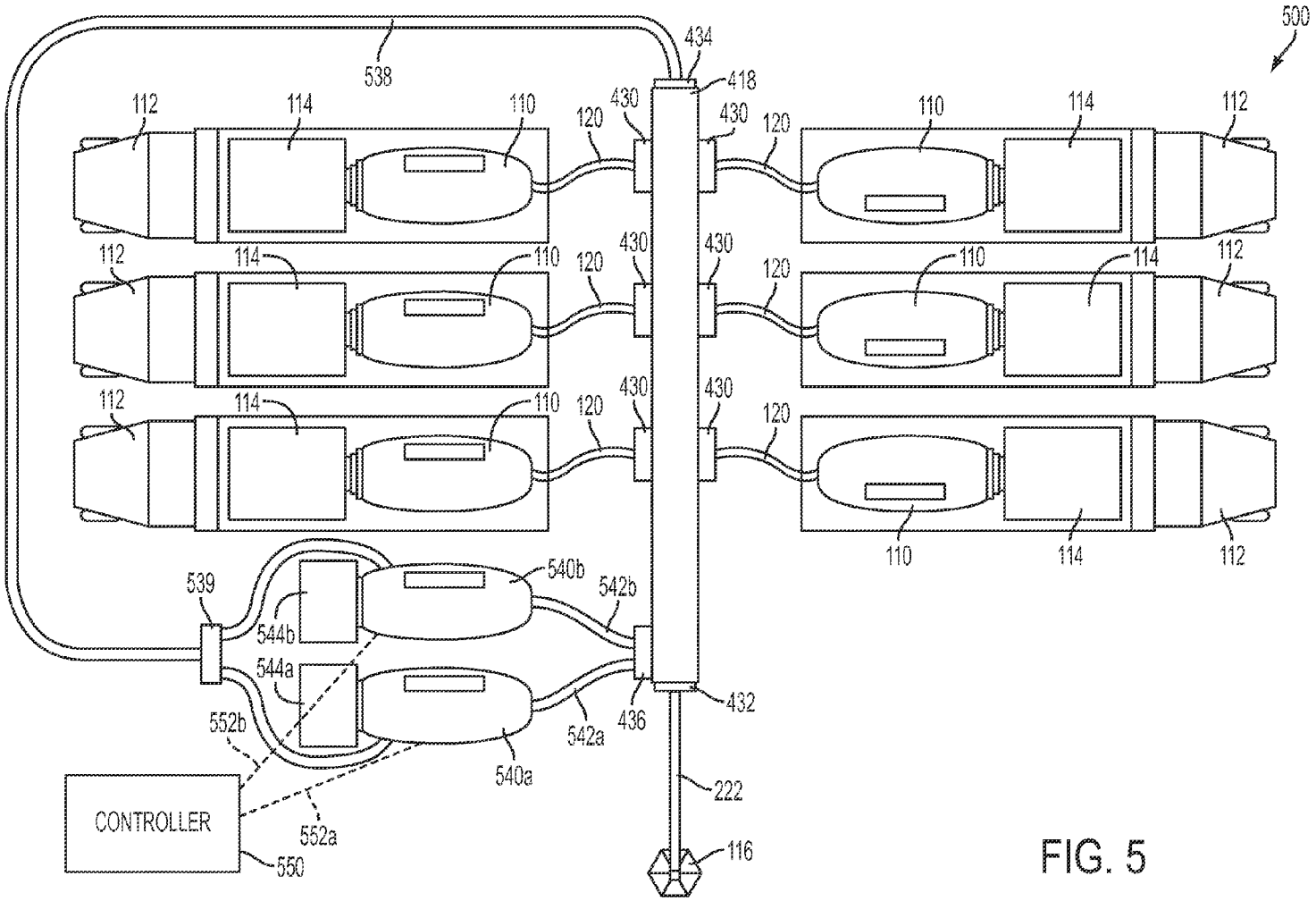
FIG. 5 is another schematic depicting a hydraulic fracturing system that includes the primary pumps and the wellhead of FIG. 1, and further includes the manifold of FIG. 4 and a pair of supplemental pumps, and further depicts the manifold operably in fluid communication with the pair of supplemental pump and with the primary pumps, according to various embodiments of the present disclosure.

In various instances, a hydraulic fracturing system can include one or more supplemental pulse-inducing pumps. A hydraulic fracturing system 500 is depicted in FIG. 5. The depicted hydraulic fracturing system 500 includes the manifold 418, having a plurality of inlets 430 in fluid communication with the primary pumps 110 via the fluid lines 120. The manifold 418 can also include the primary outlet 432 in fluid communication with the wellhead 116 and a supplemental outlet 434 in fluid communication with a pair of supplemental pumps 540*a*, 540*b*. Each pump 540*a*, 540*b* can be coupled to and/or driven by a power unit and/or motor 544*a*, 544*b*, respectively. The manifold 418 depicted in FIG. 5 also includes the supplemental inlet 436 downstream of the primary inlets 430. In the depicted arrangement, a pair of connecting conduits 542*a*, 542*b* extend between the supplemental pumps 540*a*, 540*b*, respectively, and the supplemental inlet 436 such that the pulse or pulses generated by the supplemental pumps 540*a*, 540*b* are directed into the fluid stream at the manifold 418.

In other instances, similar to the system 200, the connecting conduits 542*a*, 542*b* and the primary conduit 222 can be coupled at a supplemental manifold or union intermediate the manifold 218 and the wellhead 116. In still other instances, similar to the system 300, the connecting conduits 542*a*, 542*b* can transmit the pulses to the fluid stream at the wellhead 116. Additionally or alternatively, the connecting conduits 542*a*, 542*b* can be in fluid connection with the fluid stream at different locations downstream of the inlets 230. For example, the first connecting conduit 542*a* can be coupled to the fluid stream upstream of the second connecting conduit 542*b*. Moreover, the system 500 can include additional supplemental pumps. For example, the system 500 can include three or more supplemental, pulse-generating pumps.

Figure 6:
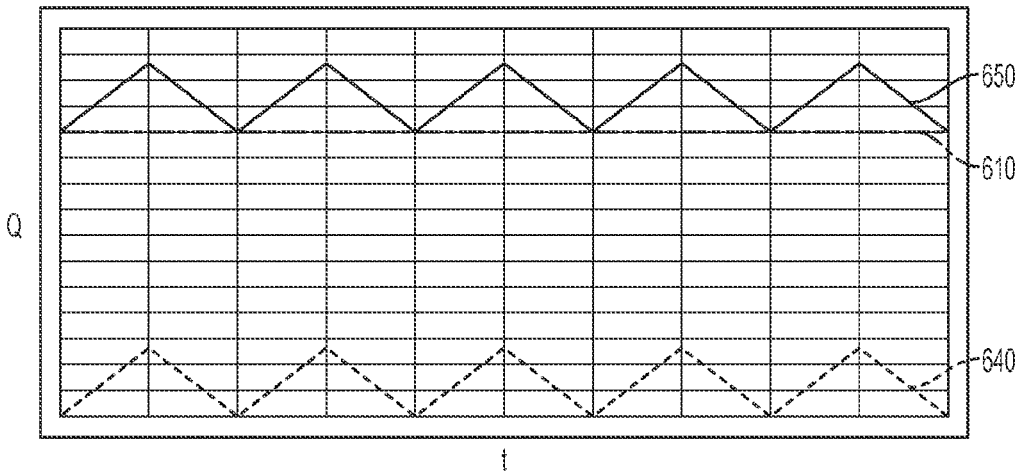
FIG. 6 is a chart depicting the output from a plurality of primary pumps, a pulsed pump, and the aggregated output of the primary and pulsed pumps, according to various embodiments of the present disclosure.

Referring to FIG. 6, an output 610 from an exemplary set of primary pumps, such as the primary pumps 110 (FIGS. 1-5), for example, is depicted. The output 610 comprises a substantially flat and/or constant output and is depicted in FIG. 6 as a horizontal line. A pulsed output 640 from an exemplary supplemental pump, such as supplemental pump 240 (FIGS. 2 and 3) and 440 (FIG. 4), for example, is also depicted in FIG. 6. The pulsed output 640 comprises a plurality of equally spaced, equal amplitude pulses. The combination of the output 610 and the pulsed output 640 is also depicted in FIG. 6.

For example, the combined and pulsed output 650 comprises the summation and/or aggregation of the output 610 and the pulsed output 640.

Figure 7:
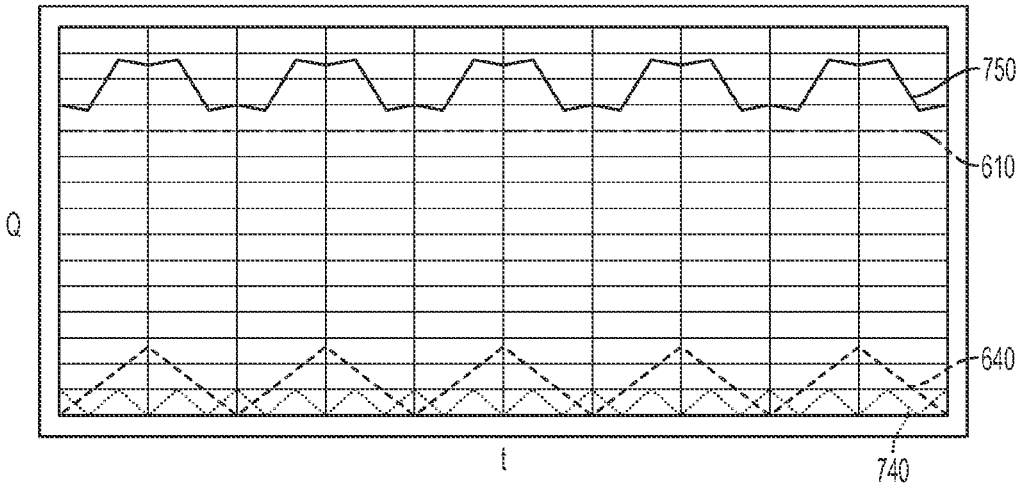
FIG. 7 is a chart depicting the output from a plurality of primary pumps, a pair of pulsed pumps, and the aggregated output of the primary and pulsed pumps, according to various embodiments of the present disclosure.

Referring to FIG. 7, the output 610 is depicted, as well as pulsed outputs 640, 740 from an exemplary pair of supplemental pumps, such as the supplemental pumps 540*a*, 540*b* (FIG. 5), for example. The first pulsed output 640 comprises a plurality of equally spaced, equal amplitude pulses, and the second pulsed output 740 also comprises a plurality of equally spaced, equal amplitude pulses. The pulse amplitude of the first pulsed output 640 can be greater than the pulse amplitude of the second pulsed output 740, for example. For example, the pulse amplitude of the first pulsed output 640 can be 1.5 to 10 times greater than the pulse amplitude of the second pulsed output 740. In the depicted instances, the pulse amplitude of the first pulsed output 640 is 2.5 times greater than the pulse amplitude of the second pulsed output 740.

Figure 8:
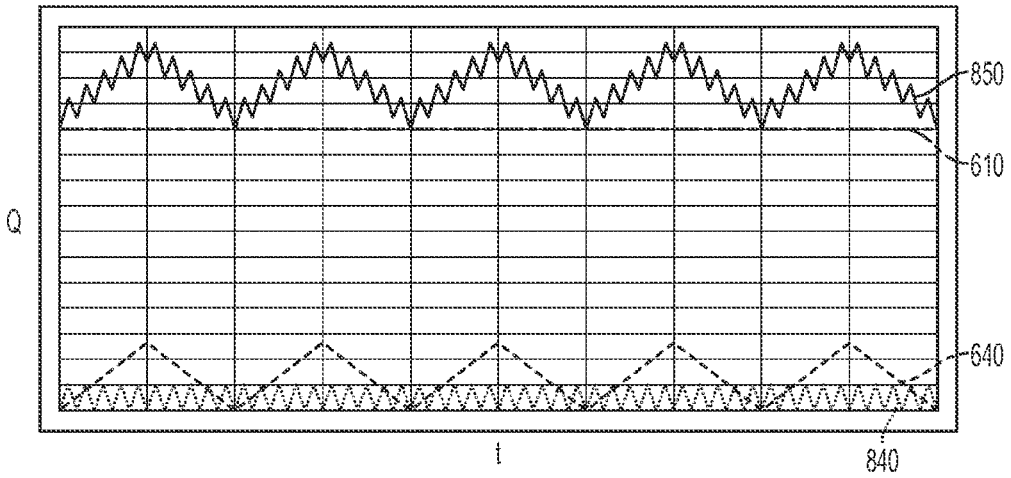
FIG. 8 is a chart depicting the output from a plurality of primary pumps, a pair of pulsed pumps, and the aggregated output of the primary and pulsed pumps, according to various embodiments of the present disclosure.

Additionally or alternatively, the pulse frequency of the second pulsed output 740 can be greater than the pulse frequency of the first pulsed output 640, for example. For example, the pulse frequency of the second pulsed output 740 can be two (2) to ten (10) times greater than the pulse frequency of the first pulsed output 640. In the depicted instances, the pulse frequency of the second pulsed output 740 is three (3) times greater than the pulse frequency of the first pulsed output 640. In other instances, referring to FIG. 8, a second pulsed output 840 comprises a pulse frequency ten (10) times greater than the pulse frequency of the first pulsed output 640. The resultant total output 850 is also depicted in FIG. 8.

Referring again to FIG. 7, in other instances, the pulsed output 640, 740 that has the greater pulse amplitude and/or magnitude can also have the greater pulse frequency. In certain instances, the pulse amplitude of the first and second pulsed outputs 640, 740 can be equal or substantially equal. Additionally or alternatively, in some instances, the pulse frequency of the first and the second pulsed outputs 640, 740 can be equal or substantially equal. For example, the pulse frequency of the first and second pulsed outputs 640, 740 can be equal or substantially equal and the pulse amplitudes of the first and second pulsed outputs 640, 740 can be different. In other instances, the pulse amplitudes of the first and second pulsed outputs 640, 740 can be equal or substantially equal, and the pulse frequencies of the first and second pulsed outputs 640, 740 can be different.

Referring still to FIG. 7, the peaks and/or troughs of the first and second pulsed outputs 640, 740 can be offset. For example, each peak of the first pulsed output 640 can correspond to a trough of the second pulsed output 740. Additionally, each trough of the first pulsed output 640 can correspond to a peak of the second pulsed output 740.

Figure 9:
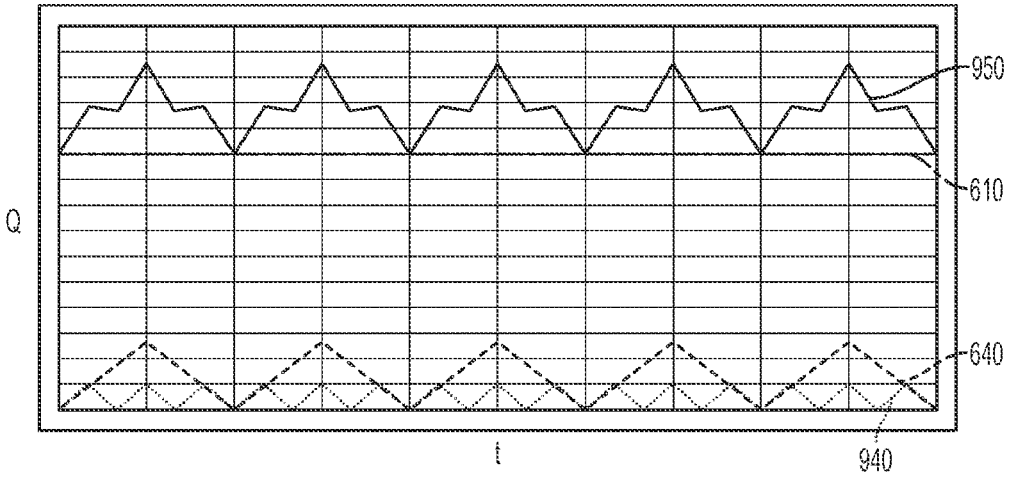
FIG. 9 is a chart depicting the output from a plurality of primary pumps, a pair of pulsed pumps, and the aggregated output of the primary and pulsed pumps, according to various embodiments of the present disclosure.

In other instances, referring now to FIG. 9, various peaks and troughs of the pulsed outputs can be aligned. For example, a second pulsed output 940 can match the second pulsed output 740 of FIG. 7, however, the pulses can be offset by ½ a wavelength. As a result, the peaks of the first pulsed output 640 are aligned with the peaks of the second pulsed output 940, for example, and the troughs of the first pulsed output 640 are aligned with the troughs of the second pulsed output 940, for example. The resultant combined output 950 is also depicted in FIG. 9.

In an exemplary embodiment, referring again to FIG. 5, the first supplemental pump 540 can deliver 5 gallon pulses of fracturing fluid every 0.25 seconds, which can result in pressure pulses of approximately 8000 psi, for example. Additionally or alternatively, the second supplemental pump 540 can deliver 1 gallon pulses of fracturing fluid every 0.125 seconds, which can result in pressure pulses of approximately 5000 psi, for example. The volume, time increment, and pressure changes can be variable and/or adjustable, for example.

In various instances, the supplemental, pulse-inducing pump or pumps of a hydraulic fracturing system can be in signal communication with a controller. For example, referring again to FIG. 5, a controller 550 can transmit signals to the pumps 540*a*, 540*b* along the communication lines 552*a*, 552*b*, respectively. Additionally, an operator can input commands to the controller 550 to affect a pulse and/or sequence of pulses. The commands to the controller 550 can depend on the hydraulic fracturing site and/or conditions. In various instances, the controller 550 can command the supplemental pump or pumps 540*a*, 540*b* to generate periodic pulses of a specific amplitude and at a specific frequency. In other instances, the controller can command the supplemental pump or pumps 540*a*, 540*b* to generate an intermittent pulse of a specific amplitude at a specific time, for example. In instances where multiple, pulse-inducing supplemental pumps are incorporated into a hydraulic fracturing system, each supplemental pump can be independently controlled to different amplitudes, frequencies, and/or times, for example. In other instances, multiple supplemental pumps can be coordinated and/or synchronously controlled.

Figure 10:
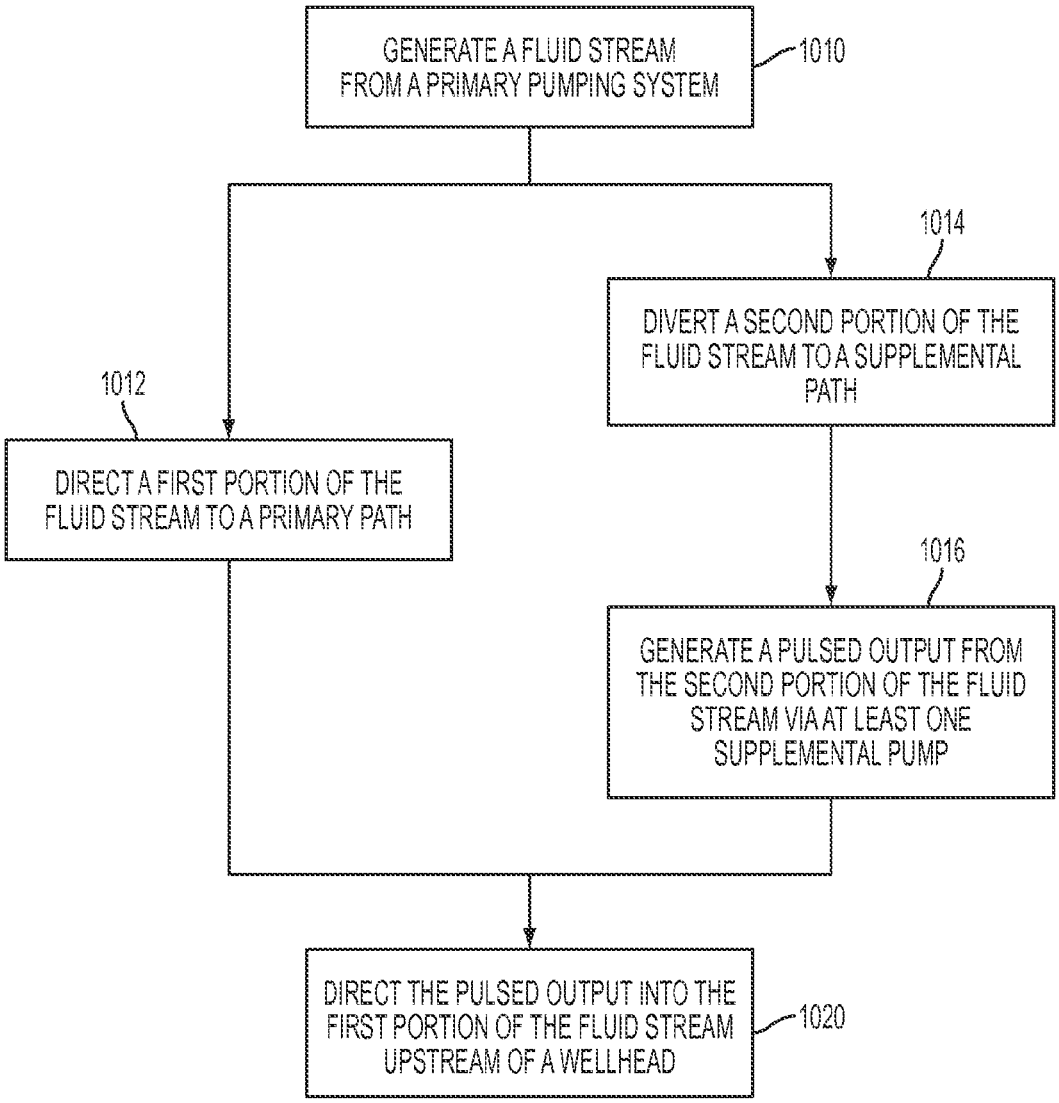
FIG. 10 is a flowchart depicting a hydraulic fracturing method, according to various embodiments of the present disclosure.

Referring now to FIG. 10, a hydraulic fracturing method is disclosed. At step 1010, the method can include generation of a fluid stream from a primary pumping system. For example, the primary pumping system can include a plurality of primary pumps, such as the pumps 110 (FIGS. 1-5), for example, which can pump fluid into a manifold. Thereafter, at step 1012, a first portion of the fluid stream can be directed along a primary path. For example, the first portion of the fluid stream can be directed toward a primary outlet of the manifold. Additionally, a second portion of the fluid stream can be directed along a supplemental path. For example, the second portion of the fluid stream can be directed toward a second outlet, which can be in fluid communication with a supplemental pump, such as supplemental pump 240, 540*a*, and/or 540*b*, for example. In certain instances, step 1012 and 1014 can occur simultaneously. In some instances, step 1014 can occur before step 1012 or vice versa, for example. In various instances, the second portion of the fluid stream can be diverted to the supplemental outlet before proppants and/or other additives are pumped into the fluid stream.

Referring still to FIG. 10, at step 1016 a pulsed output can be generated from the second portion of the fluid stream. For example, a supplemental pumping system can include at least one pulse-inducing pump, which can receive the second portion of the fluid stream via the supplemental outlet and can pump the second portion of the fluid stream to generate a pulse of fluid. In such instances, the pulse or pulses generated at step 1016 can be mechanically induced pulses, which are generated outside of the wellbore. In other words, the pulses of fluid are generated upstream of a wellhead, such as the wellhead 116 (FIGS. 1-5), for example.

At step 1020, the pulsed output from the supplemental pump system can be directed into the first portion of the fluid stream. For example, the pulsed output can be pumped into the first portion of the fluid stream at the manifold, at the wellhead, and/or between the manifold and the wellhead. As a result, the combined fluid stream can enter the wellhead and be forced down the wellbore and into the formation.

Throughout the steps 1010, 1012, 1014, 1016 and 1020 described above, a monitoring unit can monitor the fluid stream from the primary pumping system and the supplemental pumping system. Moreover, a controller can control the primary and/or supplemental pumps throughout the steps 1010, 1012, 1014, 1016 and 1020. For example, the pulsing sequences, including frequency and/or amplitude, for example, can be adjusted throughout the process.

In various instances, a pulse-inducing system can be employed to generate pulses in a hydraulic fracturing system. The pulse-inducing system can generate pulses of fracturing fluid, and can transfer the pulses of fracturing fluid into the fluid stream generated by the primary pumps. The pulse-inducing system can include a pressure storage vessel and a pulsation valve, which can release a pulse or wave of fracturing fluid. The pulse of fluid can be transferred into the fluid stream and subsequently fed down the wellbore. In certain instances, the pulse-inducing system can provide periodic pulses, for example, which can generate corresponding periodic pressure increases or spikes within the fluid stream. For example, the pulse-inducing system can deliver a pulsed output, such as the pulsed output 640 (FIGS. 6-9), pulsed output 740 (FIG. 7), pulsed output 840 (FIG. 8), and/or pulsed output 940 (FIG. 9), for example. In other instances, the pulses can be intermittent and/or sporadic. An operator can control the pulse-inducing system to deliver pulses periodically and/or sporadically, for example.

In certain instances, multiple subsystems and/or pulsation valves can be configured to generate pulses of fracturing fluid, which can be delivered to the fluid stream. The pulses can be output from different pulsation valves and can have different frequencies and/or different amplitudes, for example. In various instances, the pulses from different subsystems and/or pulsation valves can overlap, and/or can concurrently join the fluid stream. In other instances, the pulses can be staggered and/or can intermittently join the fluid stream. In certain instances, at least one pulsation valve can be configured to deliver small pulses to the fluid stream, and at least one pulsation valve can be configured to deliver larger pulses to the fluid stream (see, e.g., FIGS. 7-9). For example, the pulse-inducing system can include multiple pressure storage vessels, which can maintain different pressure levels, and each pulsation valve can be coupled to a different pressure storage vessel to release pulses of different magnitudes.

Larger pulses of fracturing fluid can break apart rock formations, thus providing more channels and/or fissures within the formation. Additionally, larger pulses of fracturing fluid can stimulate proppants and lubricants in the fracturing fluid, and can force additional proppants and lubricants within the fissures. Larger pulses of fracturing fluid can also increase abrasion within the fissures, which can further enlarge a fissure. Moreover, larger pulses of fracturing fluid can provide a shock signal to the operator of the hydraulic fracturing system.

Smaller pulses of fracturing fluid can also stimulate proppants in the fracturing fluid, which can force additional proppants within the fissures. As proppants are forced further into the fissures, the fissures can be enlarged. Additionally, the smaller pulses of fracturing fluid can also provide a shock signal to the operator of the hydraulic fracturing system.

Figure 11:
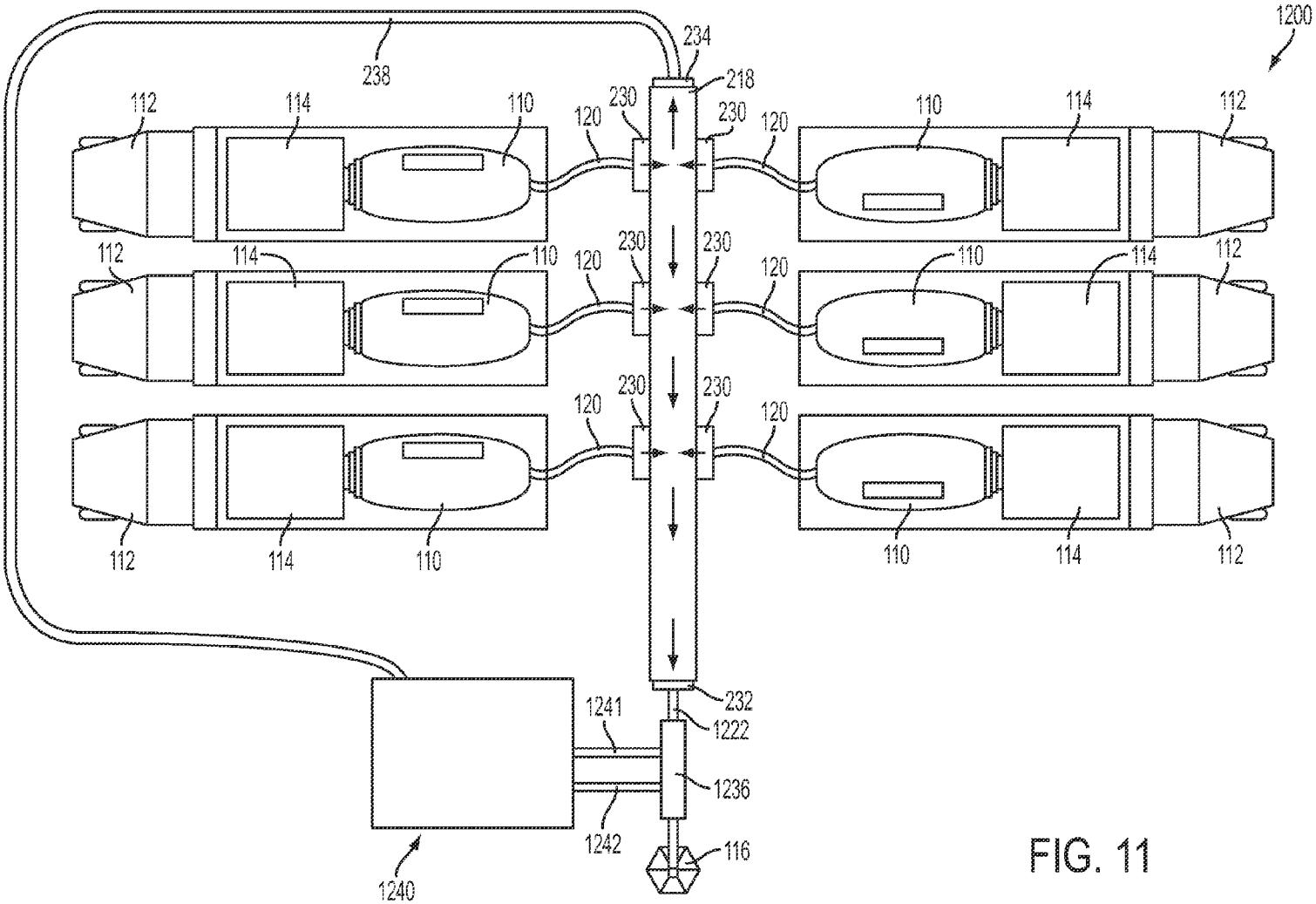
FIG. 11 is another schematic depicting a hydraulic fracturing system that includes the primary pumps and the wellhead of FIG. 1 and the manifold of FIG. 2, and further includes a pulse-inducing system and an auxiliary manifold, according to various embodiments of the present disclosure.

Referring now to FIG. 11, a hydraulic fracturing system 1200 is depicted. Similar to the system 200, the hydraulic fracturing system 1200 includes the primary pumps 110, the motors 114, the vehicles 112, the fluid lines 120 extending from the primary pumps 110, and the wellhead 116 of the wellbore. The hydraulic fracturing system 1200 also includes the manifold 218, which includes the plurality of inlets 230 fluidically coupled to the fluid lines 120. Accordingly, the fluid lines 120 permit fluid communication between the pumps 110 and the manifold 218. As depicted in FIG. 11, the manifold 218 also includes the primary outlet 232, which is coupled to the primary conduit 1222. The primary conduit 1222 extends between the manifold 218 and the wellhead 116, and can operably permit a fluid stream to flow from the manifold 218 to the wellhead 116. Similar to the hydraulic fracturing system 200, the primary pumps 110 can supply a constant flow rate and a uniform pressure into the manifold 218. As a result, the flow rate and pressure of the fracturing fluid exiting the manifold 218 can be constant or substantially constant.

Referring still to FIG. 11, the hydraulic fracturing system 1200 includes a pulse-inducing system 1240, which is described in greater detail herein. The pulse-inducing system 1240 can be in fluid communication with the manifold 218 via the supplemental outlet 234 to the manifold 218 and the supplemental conduit 238. For example, a first portion of the fluid stream that is injected or pumped into the manifold 218 from the primary pumps 110 via the fluid lines 120 can flow from the inlets 230 toward the primary outlet 232. Additionally, a second portion of the fluid stream that is injected or pumped into the manifold 218 from the primary pumps 110 can be diverted to the supplemental outlet 234. The second portion of the fluid stream can flow to the pulse-inducing system 1240, for example. In other instances, the pulse-inducing system 1240 can comprise a separate and/or independent fluid supply, and the entire fluid stream injected into the manifold 218 can be directed to the primary outlet 232 and primary conduit 1222.

In various instances, the pulse-inducing system 1240 can be configured to induce at least one pulse of fluid into the fluid stream outside of the wellbore. For example, the pulse-inducing system 1240 can generate a pulse of fracturing fluid, which can flow from the system 1240 through one of the connecting conduits 1241, 1242. Thereafter, the pulse of fluid can join the fluid stream generated by the primary pumps 110.

Referring still to the embodiment depicted in FIG. 11, the connecting conduits 1241, 1242 can extend between the pulse-inducing system 1240 and the primary conduit 1222 of the hydraulic fracturing system. As described in greater detail herein, each connecting conduit 1241, 1242 can be coupled to a separate sub-system of the pulse-inducing system 1240. For example, the first conduit 1241 can transfer a first pulse or first plurality of pulses from a first sub-system of the pulse-inducing system 1240, and the second conduit 1242 can transfer a second pulse or second plurality of pulses from the second sub-system of the pulse-inducing system 1240. In other instances, a single conduit can extend between the pulse-inducing system 1240 and the primary conduit 1222. Alternatively, more than two conduits can extend between the pulse-inducing system 1240 and the primary conduit 1222. For example, if a pulse-inducing system includes three (3) subsystems and three (3) corresponding pulsation valves, three (3) connecting conduits can extend between the pulse-inducing system and the hydraulic fracturing system.

The pulse or pulses generated by the pulse-inducing system 1240 can be generated outside of the wellbore, for example, and can be transmitted to the fluid stream outside of the wellbore, for example. In various instances, the pulse or pulses can enter the fluid stream downstream of the plurality of inlets 230 to the manifold 218. For example, the pulses can be introduced to the fluid stream between the manifold 218 and the wellhead 116. In various instances, the pulse-inducing system 1240 can transmit the pulses to the connecting conduits 1241, 1242, and the connecting conduits 1241, 1242 can be coupled to the primary conduit 1222. For example, as depicted in FIG. 11, the connecting conduits 1241, 1242 and the primary conduit 1222 can be coupled at an auxiliary manifold 1236 or union intermediate the manifold 218 and the wellhead 116.

Figure 12:
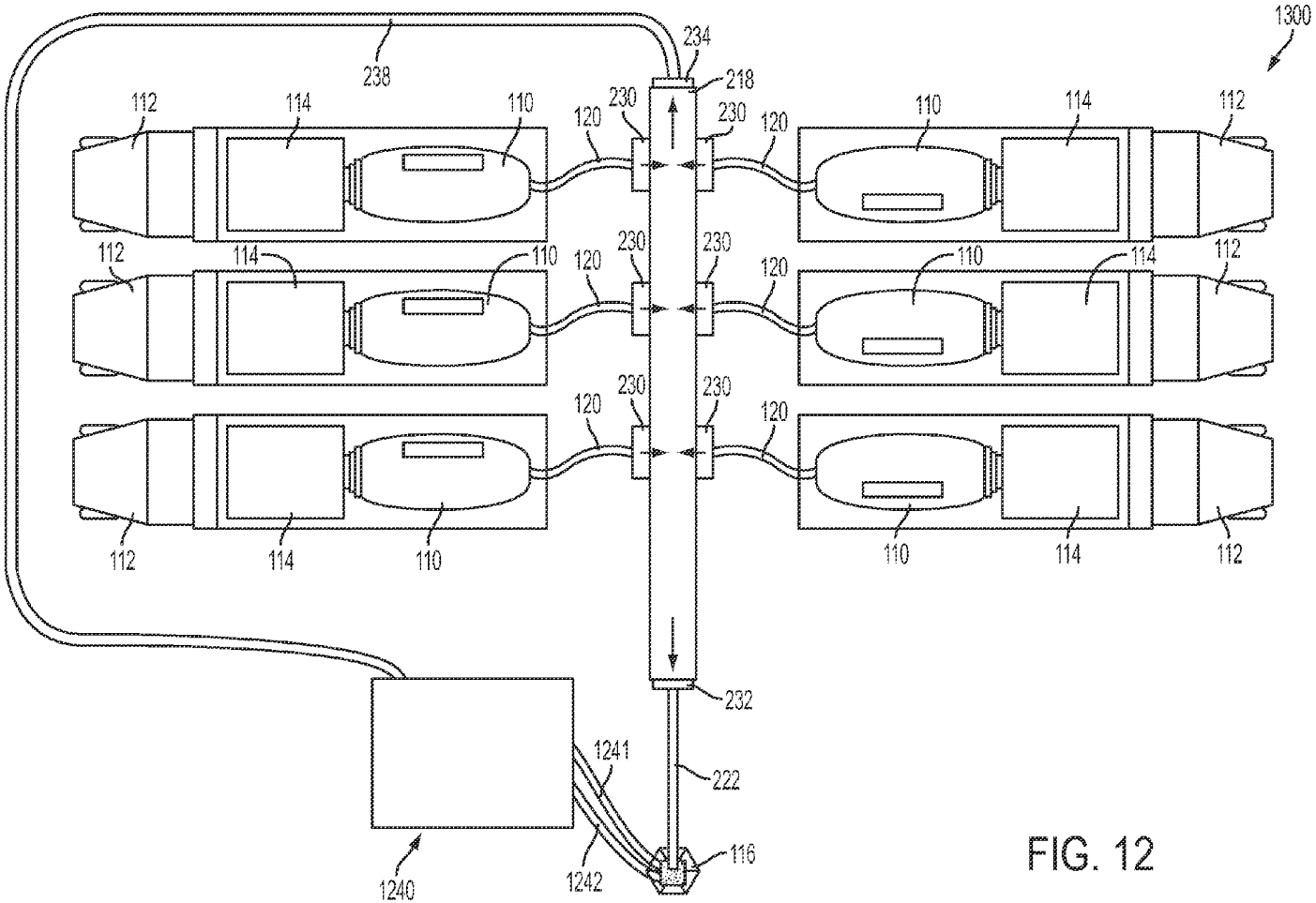
FIG. 12 is another schematic depicting a hydraulic fracturing system that includes the primary pumps and the wellhead of FIG. 1 and the manifold of FIG. 2, and further includes the pulse-inducing system of FIG. 12, according to various embodiments of the present disclosure.

In other instances, the pulse-inducing system 1240 can transmit the pulse or pulses to the fluid stream at the wellhead 116. For example, referring to FIG. 12, a hydraulic fracturing system 1300 is depicted. The hydraulic fracturing system 1300 can be similar to the hydraulic fracturing system 1200, except the connecting conduits 1241, 1242 can extend between the pulse-inducing system 1240 and the wellhead 116. In such instances, the pulse(s) from the pulse-inducing system 1240 can be transmitted to the stream of fracturing fluid at the wellhead 116.

Figure 13:
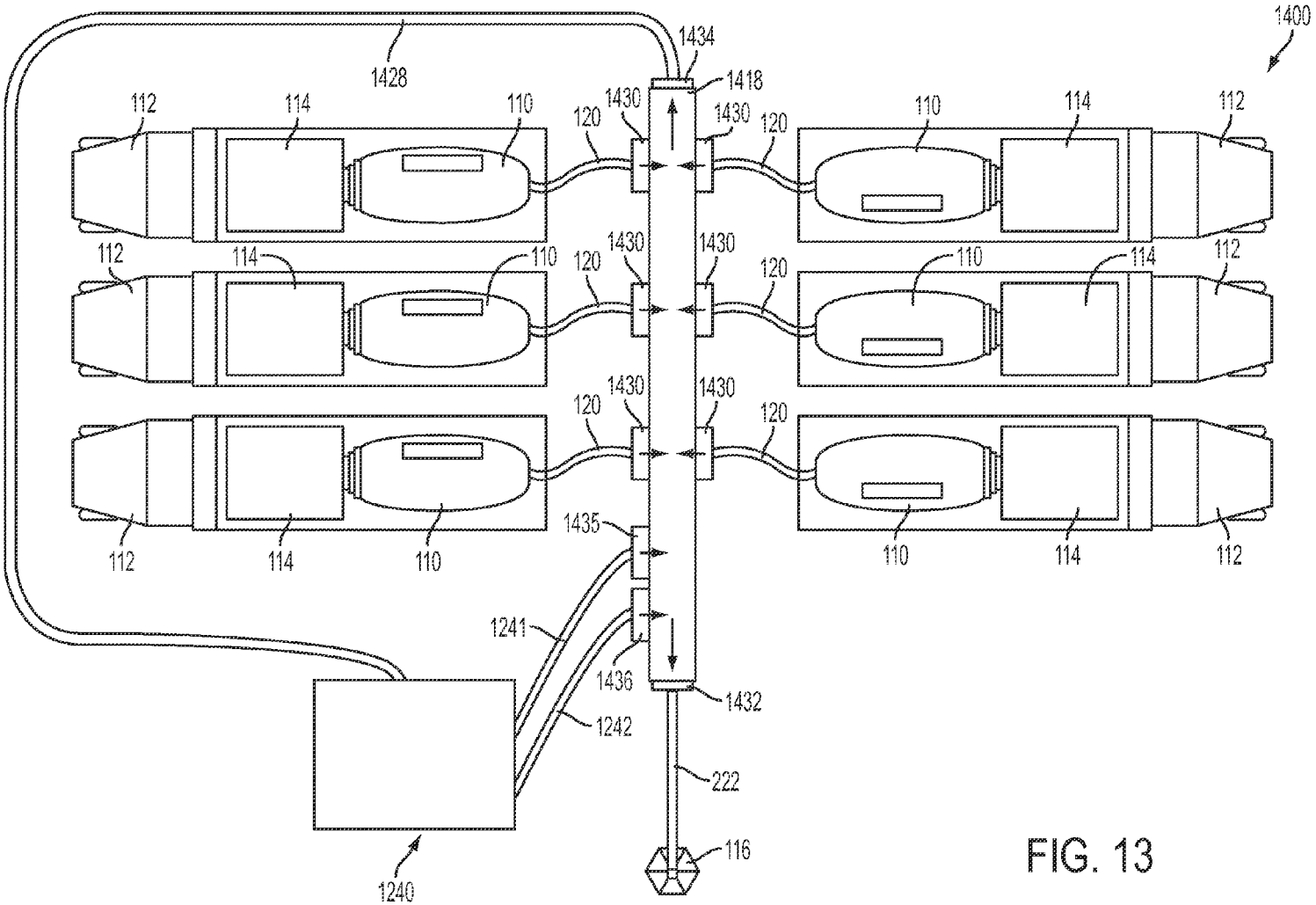
FIG. 13 is another schematic depicting a hydraulic fracturing system that includes the primary pumps and the wellhead of FIG. 1 and the pulse-inducing system of FIG. 12, and further includes a manifold having supplemental inlets, according to various embodiments of the present disclosure.

In still other instances, the pulse-generating system 1240 can transmit the pulse or pulses to the fluid stream within the primary manifold. For example, referring to FIG. 13, a hydraulic fracturing system 1400 is depicted. The hydraulic fracturing system 1400 can be similar to the hydraulic fracturing system 1200. Additionally, the hydraulic fracturing system 1400 can include a primary manifold 1418 having a plurality of inlets 1430 in fluid communication with the primary pumps 110 via the fluid lines 120. The manifold 1418 can also include a primary outlet 1432 in fluid communication with the wellhead 116 and a supplemental outlet 1434 in fluid communication with the pulse-inducing system 1240 via supplemental conduit 1438. The manifold 1418 depicted in FIG. 13 further includes a plurality of supplemental inlets 1435, 1436 downstream of the primary inlets 1430. In the depicted arrangement, the connecting conduits 1241, 1242 extend between the pulse-inducing system 1240 and the supplemental inlets 1435, 1436, respectively, such that the pulse or pulses generated by the pulse-inducing system 1240 are directed into the fluid stream at the manifold 1418.

In various arrangements described herein, the pulse-inducing system 1240 (FIGS. 11-13) can receive fluid input from the manifold 218 (FIGS. 11 and 12) or the manifold 1418 (FIG. 13), for example. In other words, a portion of the fluid stream pumped into the manifold 218, 418 can be diverted to the pulse-inducing system 1240. In such arrangements, the pulse-inducing system 1240 can receive a portion of the fluid pumped into the system 1200, 1300, 1400 from the primary pumps 110. In various instances, the portion of the fluid stream directed to the pulse-inducing system 1240 can be diverted from the fluid stream before proppants and/or other additives are added to the fluid stream. Accordingly, clogging and/or contamination of the pulse-inducing system 1240 and/or various sub-systems and/or components thereof by proppants, for example, can be prevented and/or minimized.

In certain instances 5%-50% of the fluid from the primary pumps 110 can be diverted to the pulse-inducing system 1240. For example, approximately 25% of the fluid from the primary pumps 110 can be diverted to the pulse-inducing system 1240. In other words, as an example, if 80 barrel units were pumped into the manifold 218 (FIGS. 2 and 3) of the manifold 418 (FIG. 4), for example, 60 barrel units could be directed to the primary outlet 1432 (FIG. 4) as a fluid stream, and 20 barrel units could be directed to the supplemental outlet 1434 (FIG. 4). In other instances, less than 5% or more than 50% of the fluid from the primary pumps 110 can be diverted to the pulse-inducing system 1240.

In various arrangements, the primary pumps 110 can generate a maximum pressure in the manifold 218 (FIGS. 11 and 12) or manifold 1418 (FIG. 13), for example. For example, when each primary pump 110 is operated to its maximum capacity, a maximum operating pressure $P_{max}$ can be achieved in the manifold 218, 418. Moreover, when a portion of the fluid stream is diverted to the pulse-inducing system 1240, as described herein, the pressure in the manifold 218, 418 may drop. In certain instances, the pressure can drop 5%-50% in the manifold 218, 418. For example, the pressure can drop approximately 25% within the manifold 218, 418. In other instances, the pressure drop can be less than 5% or more than 50%. When the pulse-inducing system 1240 redirects the diverted fluid stream back into the primary fluid stream as a pulse or wave of fluid, the pressure can increase toward the maximum pressure $P_{max}$, for example. In certain instances, the pressure in the fluid stream can approach $P_{max}$, however, the pressure may not reach $P_{max}$ due to frictional losses, for example. For example, the total pressure from the fluid stream in combination with the peak of each pulse can approach $P_{max}$ of the system.

A pulse-inducing system can include at least one pressure storage vessel, which can store a volume of fluid at a pressure. When the pressurized fluid is released from the pressure storage vessel, a pulse of fluid can flow from the pressure storage vessel. As described herein, the pulse of fluid can be directed into a fluid stream of a hydraulic fracturing system outside of the wellbore. The pulse-inducing system can include at least one supplemental pump, which can supply fluid to the pressure storage vessel. The fluid can include water and/or chemicals, and can comprise a fracturing fluid, for example. The pulse-inducing system can also include at least one pulsation valve, which can be fluidically coupled to one of the pressure storage vessels. The pulsation valve can control the release of fluid from the pressure storage vessel. For example, the amount of time the pulsation valve is open, the degree of opening of the pulsation valve, and the frequency of the pulsation valve opening, can affect the duration, magnitude, and frequency of the pulse or pulses, respectively.

In various instances, a pulse-inducing system can include multiple subsystems. In each subsystem, different pressures can be maintained. For example, each subsystem can include at least one pressure storage vessel, which can be sealed from the other subsystem(s). Each subsystem can further include at least one pump to supply fluid to the pressure storage vessel and at least one pulsation valve to release fluid from the pressure storage vessel. As described in greater detail herein, the subsystems can be operably connected to form one system at one pressure, for example, and can be operably disconnected to maintain different pressures.

Figure 14:
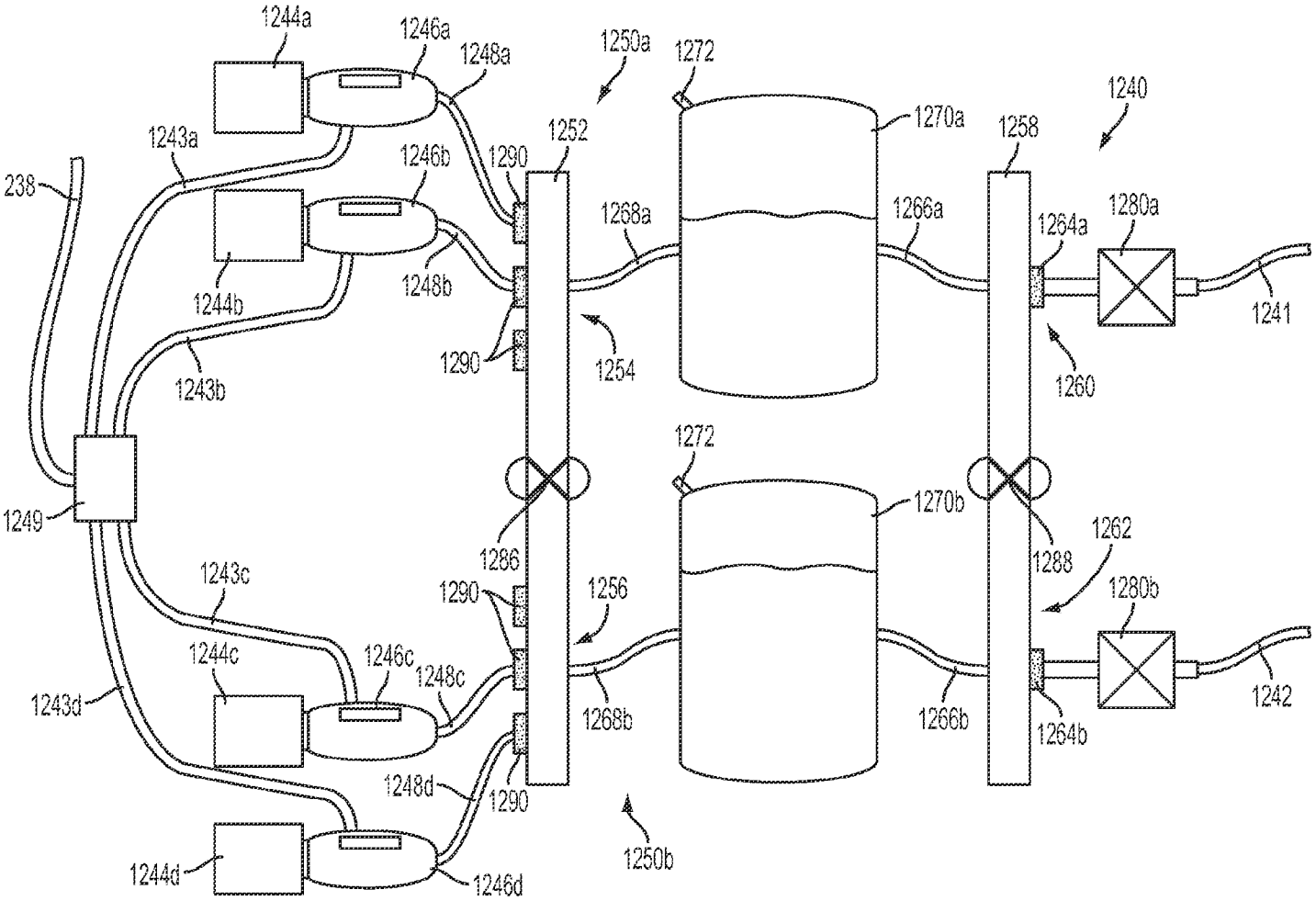
FIG. 14 is a schematic depicting the pulse-inducing system of FIG. 12, according to various embodiments of the present disclosure.

Referring now to FIG. 14, a pulse-inducing system 1240 is depicted. In the depicted embodiment, the supplemental conduit 238 provides a fluid inlet to the pulse-inducing system 1240 and the connecting conduits 1241, 1242 provide a fluid outlet from the pulse-inducing system 1240. In various instances, the supplemental conduit 238 can deliver fluid from the primary manifold 218 or manifold 1418, for example, to the pulse-inducing system 1240. In other instances, the pulse-inducing system 1240 can include an independent fluid source. For example, a designated supply vehicle, well and/or another suitable fluid supply can provide fluid to the pulse-inducing system 1240.

The pulse-inducing system 1240 depicted in FIG. 14 further includes an input manifold 1249 from which a plurality of input conduits 1243*a*, 1243*b*, 1243*c*, 1243*d* extend. The input conduits 1243*a*, 1243*b*, 1243*c*, 1243*d* provide fluid pathways from the input manifold 1249 to the supplemental pumps 1246*a*, 1246*b*, 1246*c*, 1246*d*. In the depicted arrangement, the pulse-inducing system 1240 includes four input conduits 1243*a*, 1243*b*, 1243*c*, 1243*d*, which deliver fluid from the supplemental conduit 238 and the input manifold 1249 to four supplemental pumps 1246*a*, 1246*b*, 1246*c*, 1246*d*. For example, the first input conduit 1243*a* can supply fluid to the first supplemental pump 1246*a*, the second input conduit 1243*b* can supply fluid to the second supplemental pump 1246*b*, the third input conduit 1243*c* can supply fluid to the third supplemental pump 1246*c*, and/or the fourth input conduit 1243*d* can supply fluid to the fourth supplemental pump 1246*d*.

As discussed above, the pulse-inducing system 1240 can include a plurality of supplemental pumps 1246*a*, 1246*b*, 1246*c*, 1246*d*. In other instances, the pulse-inducing system 1240 can include a single supplemental pump, as described in greater detail herein. In the embodiment depicted in FIG. 14, a power unit 1244*a*, 1244*b*, 1244*c*, 1244*d* is coupled to each supplemental pump 1246*a*, 1246*b*, 1246*c*, 1246*d*. For example, each power unit 1244*a*, 1244*b*, 1244*c*, 1244*d* can comprise a motor, which can provide power and drive each supplemental pump 1246*a*, 1246*b*, 1246*c*, 1246*d*. As described in greater detail herein, the supplemental pumps 1246*a*, 1246*b*, 1246*c*, 1246*d* can generate and/or maintain pressure in the pulse-inducing system 1240.

In other instances, the pulse-inducing system 1240 can include fewer input conduits and fewer supplemental pumps. For example, the pulse-inducing system 1240 can include a single input conduit and a single supplemental pump, as described in greater detail herein. Alternatively, the pulse-inducing system 1240 can include a two or three input conduits and two or three supplemental pumps. In still other instances, the pulse-inducing system 1240 can include more than four input conduits and more than four supplemental pumps. In various instances, the number of input conduits can correspond to the number of supplemental pumps such that an input conduit provides a fluid pathway to each supplemental pump. In still other instances, multiple conduits can supply fluid to each supplemental pump, for example.

In various instances, the supplemental pumps 1246*a*, 1246*b*, 1246*c*, 1246*d* can be configured to pump fluid into a first system manifold 1252 via output conduits 1248*a*, 1248*b*, 1248*c*, 1248*d*. For example, the first system manifold 1252 can include a plurality of inlets or fittings 1290, which can be coupled to and/or receive an end of each output conduits 1248*a*, 1248*b*, 1248*c*, 1248*d*. In such instances, the output conduits 1248*a*, 1248*b*, 1248*c*, 1248*d* and fittings 1290 can provide a fluid pathway from each supplemental pump 1246*a*, 1246*b*, 1246*c*, 1246*d* to the first system manifold 1252.

The first system manifold 1252 depicted in FIG. 14 includes a first side 1254 and a second side 1256. A first group of inlets 1290 are positioned in the first side 1254 and a second group of inlets 1290 are positioned in the second side 1256. In the depicted embodiment, an isolation valve 1286 is positioned between the first side 1254 and the second side 1256. In such instances, the isolation valve 1286 can operably seal the first side 1254 from the second side 1256. For example, when the isolation valve 1286 is closed, the fluid pathway between the first side 1254 and the second side 1256 can be closed such that fluid entering the inlets 1290 in the first side 1254 is isolated and kept separate from fluid entering the inlets 1290 on the second side 1256. Moreover, when the isolation valve 1286 is open, the fluid pathway between the first side 1254 and the second side 1256 can be open such that fluid entering the inlets 1290 in the first side 1254 can mix with the fluid entering the inlets 1290 on the second side 1256. As described in greater detail herein, the isolation valve 1286 can work in conjunction with an isolation valve 1288 to seal the subsystems of the pulse-inducing system 1240.

In various instances, as depicted in FIG. 14, the first system manifold 1252 can include additional inlets or fittings 1290. When additional supplemental pumps and corresponding output conduits are added to the pulse-inducing system 1240, the additional fittings 1290 can be configured to receive the additional output conduits. Additionally, various fittings 1290 can be sealed if one or more of the output conduits are disconnected from the first system manifold 1252.

At least one supply conduit 1268*a*, 1268*b* can extend from the first system manifold 1252 to one of the pressure storage vessels 1270*a*, 1270*b*. Referring to the embodiment depicted in FIG. 14, a first supply conduit 1268*a* can extend from the first side 1254 of the first system manifold 1252 and a second supply conduit 1268 can extend from the second side 1256 of the first system manifold 1252. When the isolation valve 1286 is closed, the fluid pathway between the first side 1254 and the second side 1256 can be closed such that only fluid entering the inlets 1290 in the first side 1254 is channeled to the first supply conduit 1268*a* and only fluid entering the inlets 1290 in the second side 1256 is channeled to the second supply conduit 1268*b*. Moreover, when the isolation valve 1286 is open, the fluid pathway between the first side 1254 and the second side 1256 can be open such that fluid entering the inlets 1290 in the first side 1254 and the second side 1256 may be transferred to both of the supply conduits 1268*a*, 1268*b*. As described in greater detail herein, the isolation valve 1286 can work in conjunction with an isolation valve 1288 to seal the subsystems of the pulse-inducing system 1240.

Referring still to FIG. 14, the first supply conduit 1268*a* can extend from the first system manifold 1252 to the first pressure storage vessel 1270*a*, and the second supply conduit 1268*b* can extend from the first system manifold 1252 to the second pressure storage vessel 1270*b*. The supplemental pumps 1246*a*, 1246*b*, 1246*c*, 1246*d* can pump fluid into the pressure storage vessels 1270*a*, 1270*b* via the first system manifold 1252 to build and/or maintain pressure in the storage vessels 1270*a*, 1270*b*. In various instances, the pressure storage vessels 1270*a*, 1270*b* can include a pressure valve 1272, which can be employed to increase the pressure in the system. For example, a gas such as ambient air, for example, can be pumped into the pressure storage vessel via the pressure valve 1272 to further increase the pressure therein. In other instances, the pressure valve can release and/or neutralize the pressure in the vessel 1270*a*, 1270*b*.

The pressure storage vessels or tanks 1270*a*, 1270*b* can be 100 gallon vessels, 200 gallon vessels, 300 gallon vessels, or larger, for example. A larger tank can provide more even pressures during pulsing. If the pressure in a pressure storage tank is 0 psi, no pulse of fluid can be released. However, if the pressure in the pressure storage tank is increased, such as to 4,000 psi, for example, a small pulse of fluid can be released. As the pressure in a pressure storage vessel is further increased, such as to 10,000 psi, 15,000 psi, or 20,000 psi, for example, successively larger pulses of fluid can be available. In various instances, the pressure in a pressure storage vessel can be increased up to the maximum pump pressure to obtain the largest pulses, for example.

In various instances, one or more supplemental pumps can provide fluid to each of the pressure storage vessels. When the isolation valve 1286 is closed (along with the isolation valve 1288 described in greater detail herein), the supplemental pumps 1246*a*, 1246*b* coupled to the first side 1254 of the first system manifold 1252 can be configured to build and/or maintain pressure in the first pressure storage vessel 1270*a*, and the supplemental pumps 1246*c*, 1246*d* coupled to the second side 1256 of the first system manifold 1252 can be configured to build and/or maintain pressure in the second pressure storage vessel 1270*b*. In such instances, the first pressure storage vessel 1270*a* and the second pressure storage vessel 1270*b* can obtain different pressures. For example, the first pressure storage vessel 1270*a* can obtain a pressure of 6000 psi, and the second pressure storage vessel 1270*b* can obtain a pressure of 4000 psi or vice versa, for example. In other instances, the first pressure storage vessel 1270*a* can obtain a pressure of 8000 psi, for example, and the second pressure storage vessel 1270*b* can obtain a pressure of 4000 psi or vice versa, for example. In other instances, even when the first and second subsystems 1250*a*, 1250*b* are isolated from each other, the pressure storage vessels 1270*a*, 1270*b* can be set to maintain the same or substantially the same pressure.

When the isolation valve 1286 is open, the supplemental pumps 1246*a*, 1246*b*, 1246*c*, 1246*d* coupled to both sides 1254, 1256 of the first system manifold 1252 can be configured to build and/or maintain pressure in both pressure storage vessels 1270*a*, 1270*b*. In such instances, the first pressure storage vessel 1270*a* and the second pressure storage vessel 1270*b* can obtain the same or substantially the same pressure.

As depicted in FIG. 14, the pressure storage vessels 1270*a*, 1270*b* can supply fluid to a second system manifold 1258 via inlet conduits 1266*a*, 1266*b*. Moreover, the second system manifold 1258 can include outlets or fittings 1264*a*, 1264*b* which can fluidically couple the second system manifold 1258 to the pulsation valves 1280*a*, 1280*b*. The pulsation valves 1280*a*, 1280*b* are configured to deliver pulses of fluid to the connecting conduits 1241, 1242, respectively. For example, the pulsation valves can be opened to varying degrees or percentages. In such instances, the degree to which the pulsation valve is opened can affect the volume of fluid released from the pressure storage vessel 1270*a*, 1270*b* per unit time. The second system manifold 1258 depicted in FIG. 14 includes a first side 1260 and a second side 1262. The first outlet 1264*a* is positioned in the first side 1260 and the second outlet 1264*b* is positioned in the second side 1262.

In various instances, an isolation valve 1288 can be positioned between the first side 1260 of the second system manifold 1258 and the second side 1262 of the second system manifold 1258. In such instances, the isolation valve 1288 can operably seal the first side 1260 from the second side 1262. For example, when the isolation valve 1288 is closed, the fluid pathway between the first side 1260 and the second side 1262 can be closed such that fluid entering the second system manifold 1258 via the first inlet conduit 1266*a* is isolated and kept separate from fluid entering the second system manifold 1258 via the second inlet conduit 1266*b*. In such instances, only fluid from the first pressure supply vessel 1270*a* can be supplied to the first pulsation valve 1280*a*, and only fluid from the second pressure supply vessel can be supplied to the second pulsation valve 1280*b*. Moreover, when the isolation valve 1288 is open, the fluid pathway between the first side 1260 and the second side 1262 can be open such that fluid entering the manifold 1258 from the first inlet conduit 1266*a* can mix with the fluid entering the manifold 1258 from the second inlet conduit 1266*b*.

In various instances, the first pulsation valve 1280*a* can release a volume of pressurized fluid, and the second pulsation valve 1280*b* can also release a volume of pressurized fluid. When the isolation valves 1286, 1288 are closed, the pulse-inducing system 1240 depicted in FIG. 14 can comprise a pair of subsystems 1250*a*, 1250*b*. In such instances, the first subsystem 1250*a* can comprise the first and second power units 1244*a*, 1244*b*, the first and second supplemental pumps 1246*a*, 1246*b*, the first side 1254 of the first system manifold 1252, the first pressure storage vessel 1270*a*, the first side 1260 of the second system manifold 1258, and/or the first pulsation valve 1280*a*, for example. Moreover, the second subsystem 1250*b* can comprise the third and fourth power units 1244*c*, 1244*d*, the third and fourth supplemental pumps 1246*c*, 1246*d*, the second side 1256 of the first system manifold 1252, the second pressure storage vessel 1270*a*, the second side 1262 of the second system manifold 1258, and/or the second pulsation valve 1280*b*, for example.

In such instances, the first subsystem 1250*a* can be configured to deliver pressure pulses of a first magnitude, first frequency, and first duration to the hydraulic fracturing system, and the second subsystem 1250*b* can be configured to deliver pressure pulses of a second magnitude, second frequency, and second duration to the hydraulic fracturing system. In various instances, the first magnitude can be different than the second magnitude, the first frequency can be different than the second frequency, and/or the first duration can be different than the second duration (see, e.g. FIGS. 7-9).

In instances where the isolation valves 1286, 1288 are open, the pressure in the first pressure storage vessel 1270*a* can be equal to or substantially equal to the pressure in the second pressure storage vessel 1270*b*. Accordingly, the magnitude of pulses from the first pulsation valve 1280*a* can be equal to or substantially equal to the magnitude of pulses from the second pulsation valve 1280*b*. However, in various instances, the first pulsation valve 1280*a* can be configured and/or controlled to deliver pulses of a first frequency and first duration to the hydraulic fracturing system, and the second pulsation valve 1280*b* can be configured and/or controlled to deliver pressure pulses of a second frequency and second duration to the hydraulic fracturing system. In various instances, the first frequency can be different than the second frequency, and/or the first duration can be different than the second duration. Moreover, the first pulsation valve 1280*a* can be opened a first degree and the second pulsation valve 1280*b* can be opened a second degree. The degree of valve opening can affect the volume of fluid released from the pressure storage vessel 1270*a*, 1270*b*.

In various instances, the supplemental pumps 1246*a*, 1246*b*, 1246*c*, 1246*d* can be designed and/or rated to withstand a maximum pressure capability. However, in certain instances, the operational pressure in the pulse-inducing system 1240 and associated equipment can be designed and/or rated to exceed the maximum pressure capability of the supplemental pumps 1246*a*, 1246*b*, 1246*c*, 1246*d*. In other words, the pulse-inducing system 1240 can generate pressure pulses that exceed the pressure output from the supplemental pumps 1246*a*, 1246*b*, 1246*c*, 1246*d*.

Figure 14A:
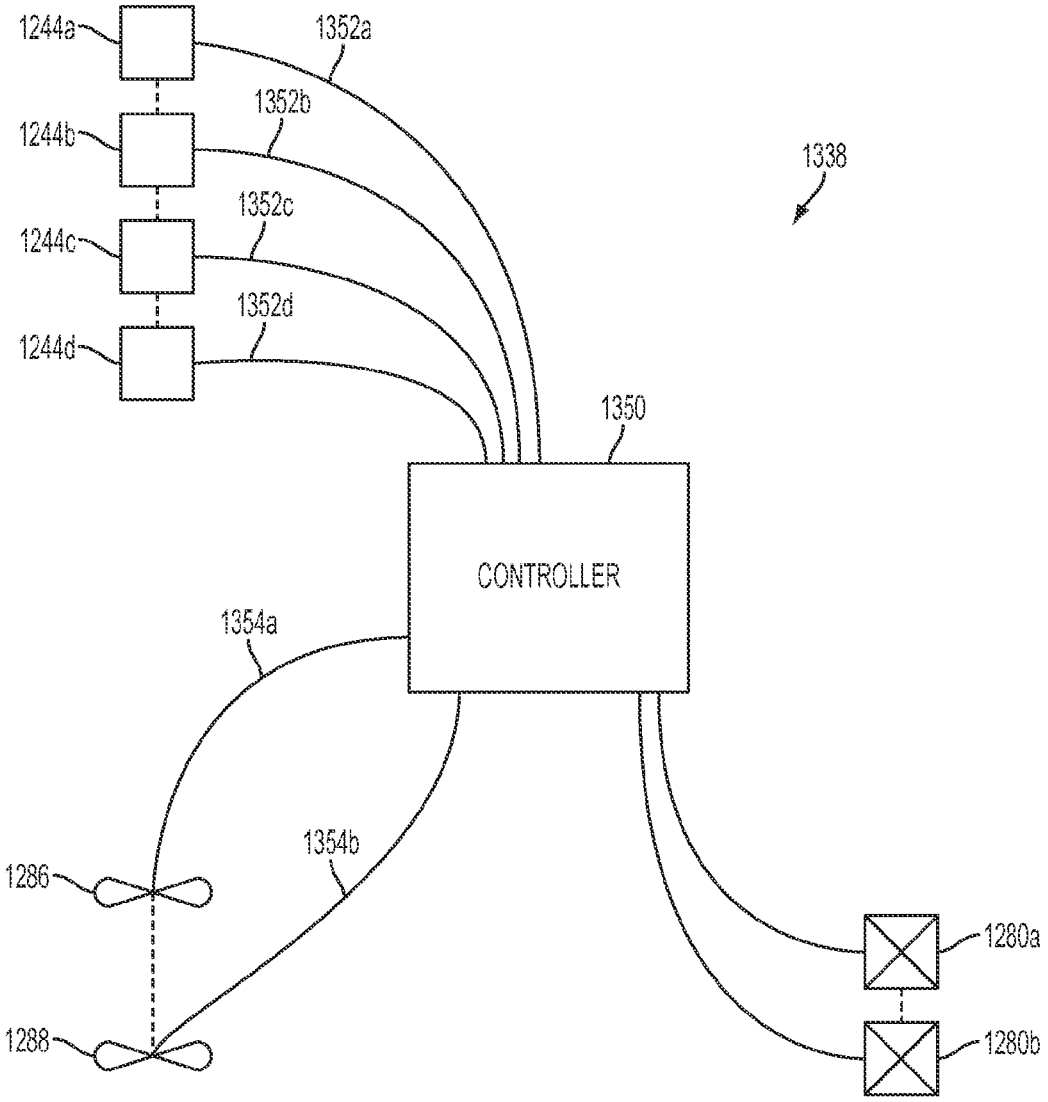
FIG. 14A is a schematic depicting a control system for the pulse-inducing system of FIG. 12, according to various embodiments of the present disclosure.

In various instances, the various components of the pulse-inducing system 1240 can be in signal communication with a control system, such as control system 1338 depicted in FIG. 14A. For example, a controller 1350 can transmit signals to the supplemental pumps 1244*a*, 1244*b*, 1244*c*, 1244*d* along the communication lines 1352*a*, 1352*b*, 1352*c*, 1352*d*, respectively. In certain instances, various supplemental pumps 1244*a*, 1244*b*, 1244*c*, 1244*d* may be in communication with each other and/or share a common communication line to the controller 1350, for example.

An operator can further affect the pulse-inducing system 1240 by controlling the isolation valves 1286, 1288. Referring to the embodiment depicted in FIG. 14A, the controller 1350 can communicate with the isolation valves 1286, 1288 along communication paths 1354*a*, 1354*b*, respectively. For example, the operator can input commands to the controller 1350 to affect opening and/or closing of the isolation valve(s) 1286, 1288, and thus, to determine the number of subsystems in operation in the pulse-inducing systems. The number of sub-systems can control the number of independent pulses and/or pulse patterns delivered to the hydraulic fracturing system. In certain instances, the isolation valves 1286, 1288 may be in communication with each other and/or share a common communication line to the controller 1350 such that both valves 1286, 1288 are either open or closed, for example.

Additionally, an operator can input commands to the controller 1350 to affect a pulse and/or sequence of pulses. The commands to the controller 1350 can depend on the hydraulic fracturing site and/or conditions. In various instances, the controller 1350 can be in signal communication with the pulsation valves 1280*a*, 1280*b* via communication lines 1356*a*, 1356*b*, respectively. For example, the controller 1350 can control the opening and closing of the valves, and can set the degree or percentage that a valve is opened. Accordingly, the controller 1350 can command the pulsation valves 1280*a*, 1280*b* to generate periodic pulses of specific amplitude(s) and at specific frequencies. In other instances, the controller can command the pulsation valves 1280*a*, 1280*b* to generate an intermittent pulse of a specific amplitude at a specific time, for example. In instances where multiple pulsation valves 1280*a*, 1280*b* are incorporated into a hydraulic fracturing system, each of the pulsation valves 1280*a*, 1280*b* can be independently controlled to different amplitudes, frequencies, durations and/or times, for example. In other instances, multiple pulsation valves 1280*a*, 1280*b* can be coordinated and/or synchronously controlled. For example, the pulsation valves 1280*a*, 1280*b* may be in communication with each other and/or share a common communication line to the controller 1350.

Figure 15:
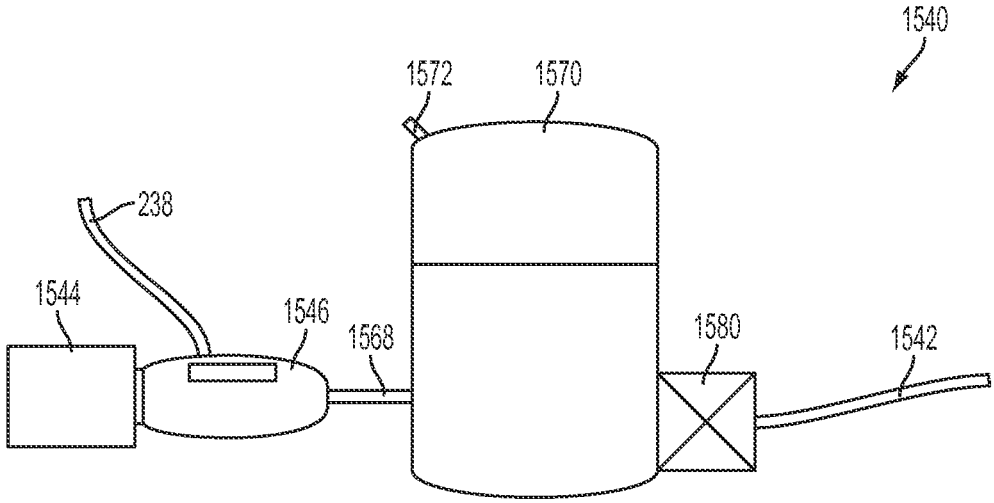
FIG. 15 is a schematic depicting a pulse-inducing system, according to various embodiments of the present disclosure.

An alternative pulse-inducing system 1540 is depicted in FIG. 15. The pulse-inducing system 1540 can be employed with various hydraulic fracturing systems disclosed herein, including hydraulic fracturing system 1200, 1300, and 1400, for example. Referring to FIG. 15, the pulse-inducing system 1540 includes a single power unit 1544 and a single supplemental pump 1546 coupled to the power unit 1544. The supplemental conduit 238 can provide fluid to the supplemental pump 1546. In the embodiment depicted in FIG. 15, the supplemental pump 1546 can provide fluid to the pressure storage vessel 1570. The supplemental pump 1256 can pump fluid into the pressure storage vessels 1570 to build and/or maintain pressure in the storage vessel 1570. In various instances, the pressure storage vessel 1570 can also include a pressure valve 1572 similar to pressure valve 1272, for example.

In other instances, the pulse-inducing system 1540 can include additional power units and/or additional supplemental pumps. For example, one or more power units can provide power to each supplemental pump. Additionally or alternatively, a single power unit can power multiple pumps. Moreover, the pulse-inducing system 1540 can include multiple pumps, which are configured to generate pressure in a single storage vessel 1570. In certain instances, the pulse-inducing system 1540 can include multiple pressure storage vessels, which can be fluidically coupled to one or more supplemental pumps. In various instances, the pressure storage vessels may be fluidically coupled and/or otherwise balanced such that the pressure is evenly distributed between the pressure storage vessels.

Referring still the embodiment depicted in FIG. 15, the pulse-inducing system 1540 includes a pulsation valve 1580, which is configured to deliver pulses of fluid. The pulsation valve 1580 can be configured and/or controlled deliver pulses having a first magnitude, first duration, and/or first frequency, for example. As depicted in FIG. 15, the pulsation valve 1580 is fluidically coupled to an output conduit 1542, which can deliver the pulse of fluid upstream of the wellhead 116.

In other instances, the pulse-inducing system 1540 can include more than one pulsation valve 1580. In such instances, the pulsation valves can be configured to independently deliver pulses to the fluid stream. For example, the pulses can concurrently join the fluid stream and/or can alternatingly join the fluid stream, for example. When the pulses join the fluid stream in unison, the largest pulses can be achieved.

Figure 16:
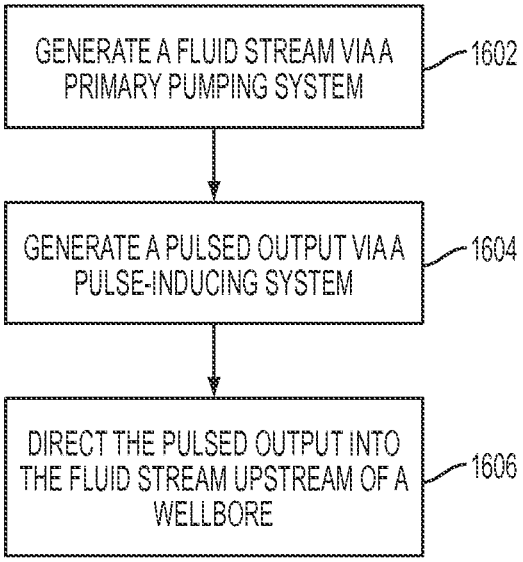
FIG. 16 is a flowchart depicting a hydraulic fracturing method, according to various embodiments of the present disclosure.

Referring now to FIG. 16, a hydraulic fracturing method is disclosed. At step 1602, the method can include generation of a fluid stream via a primary pumping system. For example, the primary pumping system can include a plurality of primary pumps, such as the pumps 110, for example, which can pump fluid into a primary manifold. Thereafter, at step 1604, a pulsed output can be generated via a pulse-inducing system. For example, the pulse-inducing system 1240 and/or 1540 can generate a pulse, multiple pulses, series of pulses, and/or multiples series of pulses. The pulse or pulses generated at step 1604 can be generated outside of the wellbore. In other words, the pulses of fluid are generated upstream of a wellhead, such as the wellhead 116, for example.

At step 1606, the pulsed output from the pulse-inducing system can be directed into the fluid stream. For example, the pulsed output can be pumped into the first portion of the fluid stream at the manifold, at the wellhead, and/or between the manifold and the wellhead. As a result, the combined fluid stream can enter the wellhead and be forced down the wellbore and into the formation.

Figure 17:
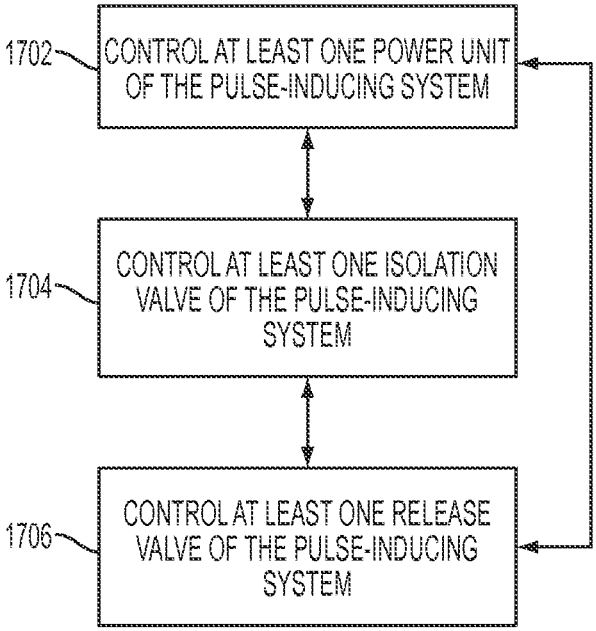
FIG. 17 is a flowchart depicting various steps for controlling a pulse-inducing system, according to various embodiments of the present disclosure.

Throughout the steps 1602, 1604, 1606 described above, a monitoring unit can monitor the fluid stream from the primary pumping system and/or the pulse-inducing system. Moreover, a controller, such as controller 1350, for example, can control the pulse-inducing system. For example, the pulsing sequences, including frequency, duration, and/or amplitude, for example, can be adjusted throughout the process. In various instances, referring to FIG. 17, a controller can control at least one power unit of the pulse-inducing system at step 1702. For example, a controller can be in signal communication with a power unit, such as power units 1244*a*, 1244*b*, 1244*c*, and 1244*d* (FIG. 14) or the power unit 1544 (FIG. 15) to control the pressure in the system. Additionally or alternatively, a controller can control the isolation valves of the pulse-inducing system at step 1704. For example, a controller can be in signal communication with the isolation valves 1286 and 1288 (FIG. 14) to control the number of subsystems in the system. Moreover, a controller can control at least one pulsation valve of the pulse-inducing system at step 1706. For example, the controller can control and/or adjust the pulse and/or pulsing sequences, including frequency, duration, and/or amplitude. In various instances, steps 1702, 1704, and/or 1706 can occur simultaneously and/or iteratively. Moreover, the steps 1702, 1704, and/or 1706 can be implemented in various different sequences.

The reader will appreciate that the various hydraulic fracturing systems and methods described herein can be employed in new wells and can be utilized at previously drilled wells to draw out additional oil and/or gas, for example. Additionally, the systems and methods described herein can employ various pumps simultaneously and/or separately. In various instances, it may be advantageous to exclusively employ the supplemental pump(s) and/or pulse-inducing system described herein for at least a portion of a hydraulic fracturing operation. In such instances, the entire fluid stream from the primary pumps 110 can be diverted to a supplemental pump or pumps and/or pulse-inducing system.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

While the hydraulic fracturing systems and/or methods have been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A hydraulic fracturing system for introducing fracturing fluid into a wellbore, wherein the hydraulic fracturing system comprises:

a manifold, comprising:

a fluid outlet; and a plurality of fluid inlets;

a plurality of primary pumps, wherein each of the primary pumps is fluidically coupled to one of the fluid inlets, and wherein the primary pumps are configured to deliver a fluid stream to the fluid outlet; and a pulse-inducing system configured to deliver pulses of fluid to the fluid stream upstream of the wellbore, wherein the pulse-inducing system comprises:

a supplemental pump;

a pulsation valve; and a pressure storage vessel intermediate the supplemental pump and the pulsation valve.

2. The hydraulic fracturing system of claim 1, wherein the supplemental pump comprises a first supplemental pump, wherein the pulsation valve comprises a first pulsation valve, wherein the pressure storage vessel comprises a first pressure storage vessel, and wherein the pulse-inducing system further comprises:

a second supplemental pump;

a second pulsation valve; and a second pressure storage vessel intermediate the second supplemental pump and the second pulsation valve.

3. The hydraulic fracturing system of claim 2, wherein the manifold comprises a primary manifold, and wherein the pulse-inducing system further comprises:

a first system manifold comprising a first inlet fluidically coupled to the first supplemental pump and a second inlet fluidically coupled to the second supplemental pump; and a second system manifold comprising a first outlet fluidically coupled to the first pulsation valve and a second outlet fluidically coupled to the second pulsation valve.

4. The hydraulic fracturing system of claim 3, wherein the first system manifold comprises a first isolation valve intermediate the first inlet and the second inlet, and wherein the second system manifold comprises a second isolation valve intermediate the first outlet and the second outlet.

5. The hydraulic fracturing system of claim 4, further comprising a control system in communication with the first pulsation valve and the second pulsation valve.

6. The hydraulic fracturing system of claim 5, wherein the control system is in communication with the first isolation valve and the second isolation valve.

7. The hydraulic fracturing system of claim 5, further comprising a plurality of power units coupled to at least one of the primary pumps, first supplemental pump, or second supplemental pump, wherein the control system is in communication with the plurality of power units.

8. The hydraulic fracturing system of claim 5, wherein the first pulsation valve is configured to deliver pulses of a first magnitude at a first frequency, and wherein the second pulsation valve is configured to deliver pulses of a second magnitude at a second frequency.

9. The hydraulic fracturing system of claim 8, wherein the first magnitude is different than the second magnitude.

10. The hydraulic fracturing system of claim 8, wherein the first frequency is different than the second frequency.

11. The hydraulic fracturing system of claim 1, wherein the manifold further comprises a supplemental inlet, and wherein the pulse-inducing system is fluidically coupled to the supplemental inlet.

12. The hydraulic fracturing system of claim 1, further comprising:

a conduit extending from the fluid outlet to a wellhead of the wellbore; and an auxiliary manifold intermediate the fluid outlet and the wellhead, wherein the auxiliary manifold comprises a fluid inlet fluidically coupled to the pulse-inducing system.

13. The hydraulic fracturing system of claim 1, further comprising:

a first conduit extending from the fluid outlet to a wellhead of the wellbore; and a second conduit extending from the pulsation valve to the wellhead.

14. A hydraulic fracturing system, comprising:

a manifold, comprising:

a first fluid outlet;

a second fluid outlet; and a plurality of fluid inlets;

a plurality of primary pumps, wherein each of the primary pumps is fluidically coupled to one of the fluid inlets, wherein the primary pumps are configured to deliver a first fluid stream to the first fluid outlet, and wherein the primary pumps are configured to deliver a second fluid stream to the second fluid outlet; and a pulse-inducing system fluidically coupled to the second fluid outlet, wherein the pulse-inducing system is configured to deliver pulses of fluid to the first fluid stream, wherein the pulse-inducing system comprises:

a supplemental pump;

a pulsation valve; and a pressure storage vessel intermediate the supplemental pump and the pulsation valve.

15. The hydraulic fracturing system of claim 14, wherein the pulse-inducing system further comprises:

a first system manifold; and a second system manifold, wherein the pressure storage vessel is intermediate the first system manifold and the second system manifold.

16. The hydraulic fracturing system of claim 15, wherein the first system manifold comprises a first inlet fluidically coupled to the supplemental pump, and wherein the second system manifold comprises a first outlet fluidically coupled to the pulsation valve.

17. The hydraulic fracturing system of claim 16, wherein the supplemental pump comprises a first supplemental pump, wherein the pulsation valve comprises a first pulsation valve, wherein the pressure storage vessel comprises a first pressure storage vessel, and wherein the pulse-inducing system further comprises:

a second supplemental pump;

a second pulsation valve; and a second pressure storage vessel intermediate the second supplemental pump and the second pulsation valve.

18. The hydraulic fracturing system of claim 17, wherein the first system manifold comprises a second inlet fluidically coupled to the second supplemental pump, and wherein the second system manifold comprises a second outlet fluidically coupled to the pulsation valve.

19. The hydraulic fracturing system of claim 18, wherein the first system manifold comprises a first isolation valve intermediate the first inlet and the second inlet, and wherein the second system manifold comprises a second isolation valve intermediate the first outlet and the second outlet.

20. The hydraulic fracturing system of claim 19, further comprising a control system in communication with the first pulsation valve and the second pulsation valve.

21. The hydraulic fracturing system of claim 20, wherein the first pulsation valve is configured to deliver pulses of a first magnitude for a first duration at a first frequency, and wherein the second pulsation valve is configured to deliver pulses of a second magnitude for a second duration at a second frequency.

22. The hydraulic fracturing system of claim 21, wherein the first magnitude is different than the second magnitude, and wherein the first frequency is different than the second frequency.

* * * * *